US007114494B2

(12) United States Patent
Baratta

(10) Patent No.: US 7,114,494 B2
(45) Date of Patent: Oct. 3, 2006

(54) FLUID PICKUP ASSEMBLY AND BLADE GUARD FOR A PAVEMENT TREATMENT APPARATUS

(75) Inventor: Anthony Baratta, Oak Park, CA (US)

(73) Assignee: Husqvarna Professional Outdoor Products Inc., Augusta, GA (US)

( * ) Notice: Subject to any disclaimer, the term of this patent is extended or adjusted under 35 U.S.C. 154(b) by 20 days.

(21) Appl. No.: 10/348,578

(22) Filed: Jan. 20, 2003

(65) Prior Publication Data

Related U.S. Application Data

(60) Continuation-in-part of application No. 09/661,957, filed on Sep. 14, 2000, now Pat. No. 6,626,166, which is a division of application No. 09/399,297, filed on Sep. 17, 1999, now Pat. No. 6,318,351.

(51) Int. Cl.
*B28D 1/02* (2006.01)

(52) U.S. Cl. ..... 125/12; 125/31.01

(58) Field of Classification Search ..... 125/12, 125/13.01; 451/451–457, 344, 359; 299/39.1–39.3, 299/81.1, 81.2; 7/156, 158, 126, 152, 159
See application file for complete search history.

(56) References Cited

U.S. PATENT DOCUMENTS

| | | | | | |
|---|---|---|---|---|---|
| 3,844,743 | A | | 10/1974 | Jones | |
| 4,055,160 | A | * | 10/1977 | Wilson | 125/13.03 |
| 4,116,843 | A | | 9/1978 | Koenig | |
| 4,484,417 | A | | 11/1984 | Klingerman | |
| 4,515,607 | A | | 5/1985 | Wolde-Michael | |
| 4,518,403 | A | | 5/1985 | Hertz | |
| 4,676,557 | A | * | 6/1987 | Shope et al. | 299/39.3 |
| 4,690,762 | A | | 9/1987 | Katsura | |
| 4,827,559 | A | * | 5/1989 | Norland | 15/322 |
| 4,998,775 | A | * | 3/1991 | Hollifield | 299/39.3 |
| 5,111,625 | A | | 5/1992 | Simpfendorfer et al. | |
| 5,122,267 | A | | 6/1992 | Giovanetti et al. | |
| 5,167,215 | A | | 12/1992 | Harding, Jr. | |
| 5,205,422 | A | * | 4/1993 | Morris | 211/70.6 |
| 5,477,844 | A | | 12/1995 | Meister | |
| 5,564,408 | A | * | 10/1996 | Bassols | 125/12 |
| 5,950,612 | A | | 9/1999 | Zuzelo et al. | |
| 5,951,219 | A | | 9/1999 | Stadtfeld et al. | |
| 6,099,080 | A | | 8/2000 | Hirashita et al. | |
| 6,105,567 | A | | 8/2000 | Sun et al. | |
| 6,106,375 | A | | 8/2000 | Furusawa | |
| 6,318,351 | B1 | * | 11/2001 | Baratta | 125/12 |
| 6,375,558 | B1 | | 4/2002 | Baratta | |
| 6,626,166 | B1 | | 9/2003 | Baratta | |
| 2002/0017817 | A1 | * | 2/2002 | Nakayama | 299/39.3 |
| 2004/0134324 | A1 | | 7/2004 | Sheddy et al. | |
| 2005/0126363 | A1 | | 6/2005 | Sheddy et al. | |
| 2005/0126555 | A1 | | 6/2005 | Sheddy et al. | |
| 2005/0193883 | A1 | | 9/2005 | Sheddy et al. | |

* cited by examiner

*Primary Examiner*—David B. Thomas
(74) *Attorney, Agent, or Firm*—Henricks, Slavin & Holmes

(57) ABSTRACT

Abrading and cutting devices such as saws include waste containment systems and methods to improve removal of slurry or other contaminants from a work area during operations, and separation of slurry from a carrying medium such as air. A blade guard includes fluid channels, and may be removable from a blade guard carriage. The carriage may be used to minimize any need to readjust the blade guard position when the blade guard is returned to the carriage for further use. A vacuum bar may be included on the carriage. A vacuum pickup assembly may be used with a blade guard, and the vacuum assembly may include separate and/or different vacuum pickup configurations.

30 Claims, 29 Drawing Sheets

FLUID PICKUP ASSEMBLY AND BLADE GUARD FOR A PAVEMENT TREATMENT APPARATUS

CROSS REFERENCE TO RELATED APPLICATIONS

This application is a continuation-in-part of appilcation Ser. No. 09/661,957, filed Sep. 14,2000, now U.S. Pat. No. 6,626,166, issued Sep. 30, 2003, which is a division of Ser. No. 09/399,297, filed Sep. 17, 1999, now U.S. Pat. No. 6,318,351, issued Nov. 20, 2001.

BACKGROUND OF THE INVENTIONS

1. Field of the Invention

The present inventions relate to abrading and cutting devices and methods, and more specifically to waste containment systems and methods for such devices and methods, for example slurry containment systems and methods for saws, cutters and the like.

2. Related Art

Pavement treatment apparatus and methods are known for concrete and asphalt saws which may include a vacuum apparatus for removing water and particulate matter, commonly referred to as slurry, from a work site. See Bassols, U.S. Pat. No. 5,564,408, entitled Pavement Treatment Method and Apparatus, the specification and drawings of which are incorporated herein by reference. As discussed in that patent, concrete and asphalt saws are typically used to cut joints for expansion and contraction of such materials in freeway pavement, aircraft runways, and other pavement surfaces. Typical saws are marketed under different brand names and include a diamond blade of different diameters according to the thickness of the pavement to be cut, such as 12, 14, 16, or 24-inch blades, etc., driven by an internal combustion engine. The engine is also used to drive a traction mechanism at the rear of the saw for advancing the saw along the pavement. A belt takes power from a pulley driven by the internal combustion engine for powering a transmission box to step down the revolutions per minute (rpm) of the engine to a suitable rate for driving the traction wheels of the saw and for driving the saw blade.

The saw blade includes a blade guard for protecting the blade during operation and for preventing injury while the blade is rotating. The blade guard also contains cooling water sprayed onto the blade so that the cooling water drops onto the pavement.

The saw also includes a structural support frame for supporting all of the components and for mounting the wheels to the saw. The frame supports the engine, the shaft for driving the saw blade, the traction transmission and the pulleys for powering the traction transmission from the engine, among other elements.

In operation, the saw is started and positioned in alignment with the desired cutting path, and lowered into engagement with the pavement while at the same time turning on the coolant spray to the blade. An additional vehicle or other source is located nearby for supplying water for cooling the blade through a suitable hose. As cutting continues, the water and resulting slurry from the abraded pavement is picked up by a suction or vacuum bar to minimize filling previously cut joints. The slurry and any air picked up by the vacuum bar is taken back to a separator tank for removing the slurry. A disposal hose transports waste from the collection tank through a diaphragm pump to a truck or other container for disposal.

SUMMARY OF THE INVENTIONS

Waste containment systems and methods are described for abrading and cutting apparatus which provide improved removal of slurry and improved operating life of various components in the system. Such systems and methods may be used on saws, such as pavement and concrete saws, other cutting tools, such as wall saws, core drills and other boring equipment, and the like. The systems and methods may be implemented as original equipment or as accessories in kit form or individual components.

In one aspect of one of the inventions, a material pickup element is provided for picking up a fluid, which may include solid particles forming a slurry. The pickup element may be a vacuum bar, vacuum shoe or other suction device, for example. Element includes a number of openings comprising at least one and preferably a set of low vacuum apertures and at least one and preferably a second set of high vacuum apertures. In a preferred embodiment, the high vacuum apertures pickup most if not all of the slurry, and the low vacuum apertures focus, collect, concentrate or align the slurry so that it can be more easily picked up by the high vacuum apertures. For example, the low vacuum apertures can center or bring in fluid from both sides of the vacuum element so that an adjacent high vacuum aperture can pickup the slurry. Using both low and high vacuum apertures helps to conserve vacuum pressure, or minimize the loss of vacuum through larger openings, especially where the amount of vacuum available is limited or fixed. Conversely, using both low and high vacuum apertures permits placement of high vacuum areas where they may be most beneficial, and reduction of aperture size at other areas of the pickup element where high vacuum would not have significant incremental value over others already included.

In one preferred form of the pickup element, the low vacuum apertures are round or similar holes and the high vacuum apertures are extended slots in the pickup element. The round holes may be grouped in a series, and the round holes may be co-linear with a slot. Other configurations, arrangements and orientations for the openings can be used.

In one preferred aspect of one of the inventions, the pickup element is used on a concrete or similar saw which moves along the work surface. The openings are preferably distributed over the pickup element so as to take advantage of the forward or backward motion of the saw. In one preferred embodiment, the high vacuum apertures are placed in front of the low vacuum apertures, which in turn may be followed by one or more additional high vacuum apertures. Alternatively, high and low vacuum apertures may alternate along the pickup element, for example beginning and ending with high vacuum apertures. The pickup element can then bring in fluid from both sides of the element, minimize or limit flow over the work surface and tailor the location or flow of the slurry relative to the pickup element.

In a further preferred aspect of one of the inventions, one or more of the apertures or openings may extend along a surface of the pickup element in a direction at least partly perpendicular to the work surface. For example, in a vacuum bar that extends horizontally, most of the apertures can, open downwardly and extend horizontally over a horizontal surface of the vacuum bar and a high vacuum aperture can extend vertically or in a direction other than downwardly. A vertically extending high vacuum aperture can be advantageous directly behind the saw blade.

In a further aspect of one of the inventions, a system can be used for designing pickup elements. The system can include a processor or computer loaded with a computational fluid dynamics fluid flow optimizing program to optimize the flow of the slurry and maximize the suction created by the fan. Input parameters include maximum vacuum available, desired fluid flow rates through the pickup element, and the like. The system preferably identifies possible as well as optimum sizes and configurations for pickup elements, and potential and optimum sizes, configurations and distributions of vacuum openings. In one preferred embodiment, the system is used to identify the sizes, shapes and locations of openings to be used for picking up slurry, in addition to the sizes, shapes and locations of openings to be used for focusing, channeling or otherwise controlling flow of the slurry away from the pickup element.

In a further aspect of one of the inventions, the pickup element can include removable end caps having curved surfaces for more easily negotiating or riding over pebbles or other objects which may be in the line of travel. Having removable end caps makes for easier cleaning of the pickup element.

In another aspect of one of the inventions, a tool guard such as a blade guard includes a water supply conduit or tube for projecting or spraying fluid onto the tool. The fluid may be used as a lubricant and/or coolant for the tool. The fluid is directed toward the tool at an angle different than 90 degrees. For example, the fluid can be directed backward toward an on-coming surface of the tool. Directing the fluid backward relative to the motion of the tool reduces the amount of fluid thrown forward of the tool. Consequently, the amount of fluid to be picked up at the front of the tool is reduced. In one preferred embodiment, the fluid is directed backward about three degrees from a line perpendicular to the tool, such as a blade.

In a further aspect of one of the inventions, a separation system and method are provided for separating air and a second fluid. A receptacle is provided for receiving a combination of air and the second fluid, the receptacle including at least two vertically extending walls joining at a vertically extending angle. An inlet receives a combination of air and the second fluid and allows the combination to flow into the receptacle. A first outlet passes the second fluid from the receptacle and a second outlet passes air from the receptacle. This configuration contributes to providing a receptacle which more completely separates the air from the second fluid. This configuration makes the flow and disposition of the second material more controlled or organized, while promoting more uncontrolled or disorganized air flow. This type of receptacle configuration also reduces any tendency toward cyclone-type action in the fluid flow, for the air and for the second fluid. It also reduces the amount of symmetry in the surfaces in the receptacle, and in combination with other features, reduces residual splashing of the second fluid.

In another aspect of one of the present inventions, an inlet for a separation system discharges the air and fluid combination closer to the bottom of the receptacle than to the top. With this configuration, the fluid has a shorter distance to travel to the bottom of the receptacle, reducing the amount of splashing and reducing the amount of time the moving air from the inlet is around the moving fluid from the inlet. Additionally, when the outlet for the air is at the top of the receptacle, the air will have more time and area for shedding fluid before leaving the receptacle. Consequently, the air leaving the receptacle has a lower fluid content. Furthermore, where the fluid has abrasive, corrosive or other harmful material, the amount of harmful material leaving the receptacle through the air outlet and reaching other components is reduced.

In an additional aspect of one of the present inventions, an air outlet for a receptacle in a separation system is positioned off of a line, axis or plane of symmetry. Positioning of the air outlet in this way removes air that is less controlled or less organized earlier than air in other locations of the receptacle where the air may be more channeled. In one preferred embodiment, the only plane or line of symmetry for the air outlet is one between vertically extending walls of the receptacle. Locating the air outlet on this plane of symmetry reduces the possibility of exiting air pulling with it condensed fluid from either of the walls.

In a further aspect of one of the present inventions, an inlet for a separation system discharges an air and fluid combination into a receptacle between two vertically extending walls, and closer to one vertically extending wall than to the other. This asymmetry tends to reduce splashing of the second fluid and contributes to greater control, containment or organization of the second fluid.

In one aspect of the present inventions, a tool is provided for working a material, such as cutting concrete, where the tool is driven by a drive element, such as drive shaft. Vacuum is created by a vacuum generator driven by the same drive shaft that drives the tool. Such a design provides for a compact and self-contained combination of tool and waste containment system. The design also makes it easier to assemble the combination as a tool and kit for easy assembly and disassembly.

In another example of a tool guard, the tool guard has at least one wall with an edge portion extending adjacent a work piece to be operated on by the tool, and the at least one wall extends away from the edge portion, for example in the general direction in which the tool extends away from the work piece. A second wall portion contacts the at least one wall on the surface of the at least one wall which is on the same side as the tool is located, and extends from the wall in a direction away from the at least one wall, for example toward the tool. The second wall portion may start adjacent the edge portion and extend away from the edge portion, for example at an angle to that part of the edge portion where the second wall portion starts. In another example, the second wall portion may start further away from the edge portion and extend still further from the edge portion. In one example, the second wall portion is configured so the material can travel along the second wall portion in part through gravity and at least partly toward the edge portion.

In a further example of a tool guard, the tool guard has at least one relatively flat wall with a relatively straight edge portion extending adjacent a work piece to be operated on by the tool. The at least one wall extends away from the area of the work piece and extends generally adjacent the tool. A second wall portion fixed to the at least one wall includes a flange portion, which extends away from the at least one wall in the direction in which the tool is spaced from the at least one wall. Generally, the second wall portion extends along the at least one wall in a direction other than horizontal during normal operation of the tool. The second wall portion may have more than one segment, wherein one segment extends at an angle relative to the other segment. In one example, the tool is a saw blade and the tool guard is a blade guard wherein the second wall portion is on the same side of the at least one wall as the saw blade and extends away from the at least one wall. With many saw designs, the blade guard floats relative to the saw blade as the saw blade cuts into the work piece, with an edge portion of the at least one wall adjacent the work piece. The second wall portion generally includes a slope that allows material to flow along the second wall portion under the influence of gravity toward the edge portion. If the second wall portion has more than one segment, the segments can be oriented at angles relative to each other.

Another example of a tool guard has first and second oppositely facing walls extending on respective sides of a tool, for example a saw blade, and the first oppositely facing wall includes a third wall extending toward the second oppositely facing wall and the second oppositely facing wall includes a fourth wall extending toward the first wall. The first and second walls include respective edge portions adjacent a work surface and each of the third and fourth walls are preferably non-parallel with the edge portions. In one example, the third and fourth walls are positioned opposite each other. In a further example, the third and fourth walls each have first and second segments wherein the first segments are spaced apart from each other and wherein the second segments are joined by a joining wall. In another example, at least one of the third and fourth walls is configured to direct material flow to an outlet, opening or flow conduit, with the help of gravity or other forces. For example, where a fluid such as a liquid is used as the lubricant or coolant for the tool, the third and fourth walls may help flow material toward an outlet or disposal opening. The third and fourth walls, and any joining walls, can serve as water channels or water flow guides. The walls can also serve as baffles, vanes or other flow directors or flow preventers to help transmit fluid to a desired location or to limit flow in a given direction. For example, where the guard is used in conjunction with a vacuum assembly, the walls can be used to direct fluid toward a vacuum port. The walls may also limit the flow of fluid toward a back wall of the blade guard, for example.

In another example of a blade guard assembly, the assembly includes a blade guard support on a support surface, and a blade guard is configured to engage the support and be removable from the support. A blade guard support element on the blade guard support can be used to help support the blade guard. A rolling element on the blade guard support, such as a wheel, may be used to make easier the movement of the assembly, and permit the blade guard support to remain on the support surface when the blade guard has been removed.

In another example, a blade guard assembly includes a blade guard support and a blade guard, wherein the blade guard includes walls defining an opening for allowing fluid to flow from the blade guard to the support. In one example, the blade guard support includes a complementary opening for receiving the fluid, and where the blade guard support includes vacuum attachment means, vacuum can be used to remove fluid from the blade guard through the opening. One or more fasteners can be used to secure the blade guard to the blade guard support.

A tool guard and vacuum assembly has a tool guard extend adjacent the tool, and the vacuum assembly assembled with the tool guard has a plurality of walls defining openings. The vacuum assembly also includes two walls defining respective first and second passage ways communicating with two openings in the vacuum assembly. The first and second passage ways have different shapes. In one example, the passage ways have different cross-sectional areas. In another example, the passage ways follow different paths, and in a further example, the passage ways have different cross-sectional areas and follow different paths.

These and other aspects of the present inventions will be better understood after a consideration of the drawings, a brief description of which follows, and the detailed description of the preferred embodiments of the inventions.

DETAILED DESCRIPTION OF THE PREFERRED EMBODIMENTS

The following specification taken in conjunction with the drawings sets forth the preferred embodiments of the present inventions in such a manner that any person skilled in the art can make and use the inventions. The embodiments of the inventions disclosed herein are the best modes contemplated by the inventor for carrying out the inventions in a commercial environment, although it should be understood that various modifications can be accomplished within the parameters of the present inventions.

In accordance with several aspects of the present inventions, a waste containment system and method are provided for abrading, cutting or coring machines. While the description herein will be directed primarily to cutting machines, and while the preferred embodiments will be described with respect to applications to concrete saws, it should be understood that the inventions can be applied to any number applications other than concrete saws and other cutting machines. The concepts are applicable to other machines in a manner similar to how they would be applied to concrete saws as described herein. For example, the high and low vacuum openings on a material pickup element can be applied to any number applications, while they are especially pertinent to those where the amount of vacuum is limited or fixed. As another example, the separation receptacle can take any number of configurations given the concepts described herein. Moreover, other aspects of the inventions described herein can be used in any number of applications.

A waste containment system and method on a concrete saw in accordance with various aspects of the present inventions provide an efficient and reliable apparatus and method for limiting or entirely removing any waste material created or generated while cutting concrete. The system and method removes a substantial amount of water or other coolant produced during the cutting process. The vacuum used to remove the slurry can be easily generated through the engine or other power plant on the saw without noticeably reducing its output. Waste material can be reliably removed from the vacuum system so as to reduce contamination or fouling of components, and to give an acceptable operating lifetime to the components. The system and methods can be implemented as a complete product or as individual components, such as in kit form. All parts can be made removable, and they can be used to retrofit many existing saws.

Figure 1:
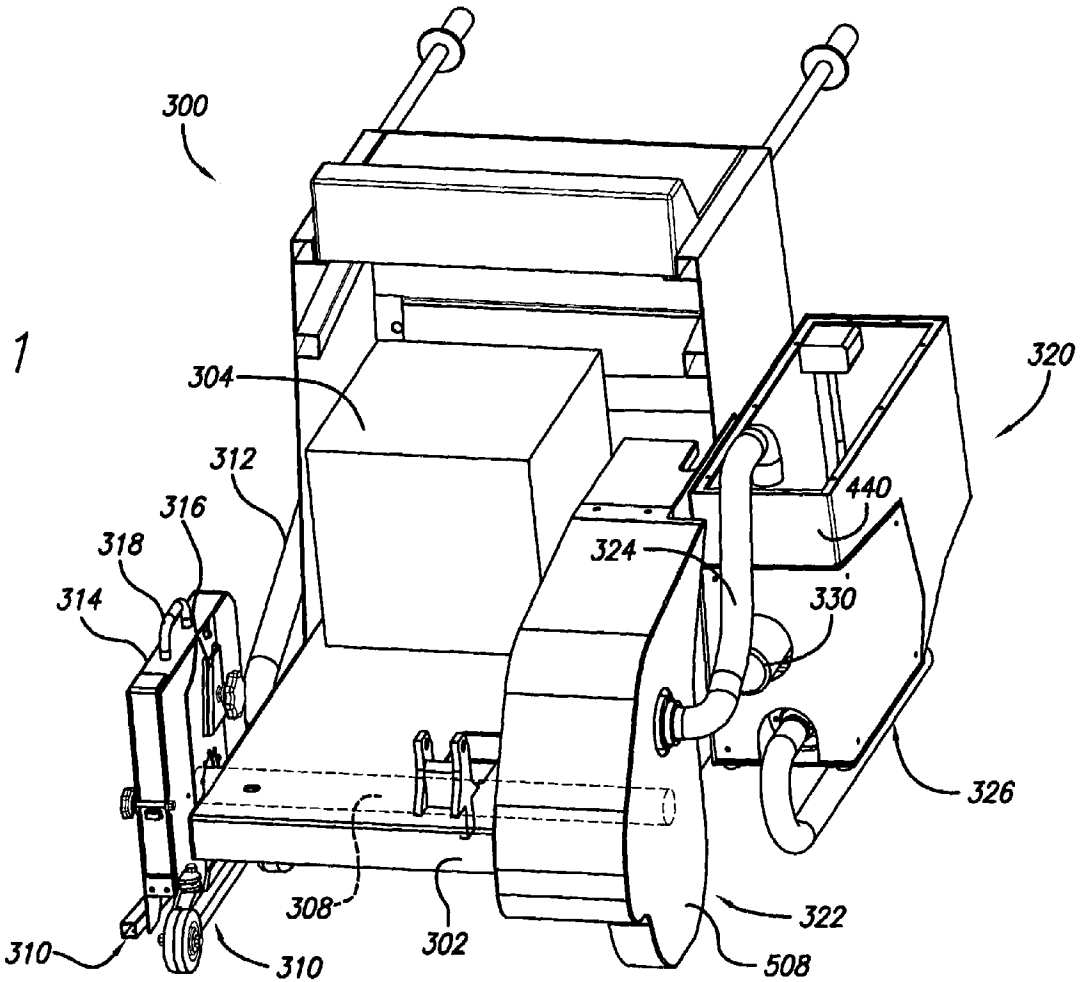
FIG. 1 is a left front isometric view of a cutting device in the form of a saw incorporating a waste containment system in accordance with several aspects of the present inventions.

In accordance with one aspect of the present inventions, a concrete saw 300 (FIG. 1) includes a frame or chassis 302 supporting an engine, shown schematically as 304, for driving a saw blade 306 through a drive shaft 308. The engine and the drive shaft, as well as other transmission components, also drive and power other components of the saw, as is known to those skilled in the art of concrete saws. The saw and saw blade can also be powered and driven by an electric motor, and all of the components on it can be driven or energized electrically.

The saw also includes a material pickup element in the form of a vacuum bar 310 to which is coupled a preferably 2 inch diameter vacuum hose 312 for removing a slurry of water and particulates created during cutting. Water is provided through a conduit (not shown) to the inside of the blade guard 314 to act as a coolant for the blade 306. The particulates are typically bits of concrete both large and small produced during cutting. Other waste material will be produced using other equipment on different work surfaces, but many of the concepts described herein will be similarly applicable. The blade guard 314 is preferably similar or identical to a blade guard described in U.S. Pat. No. 5,564,408, and is supported by a blade guard mount 316, shown in FIG. 1 configured for mounting on a saw such as that manufactured by Cushion Cut. The blade guard includes a top mounted handle 318 for ease of access.

Figure 2:
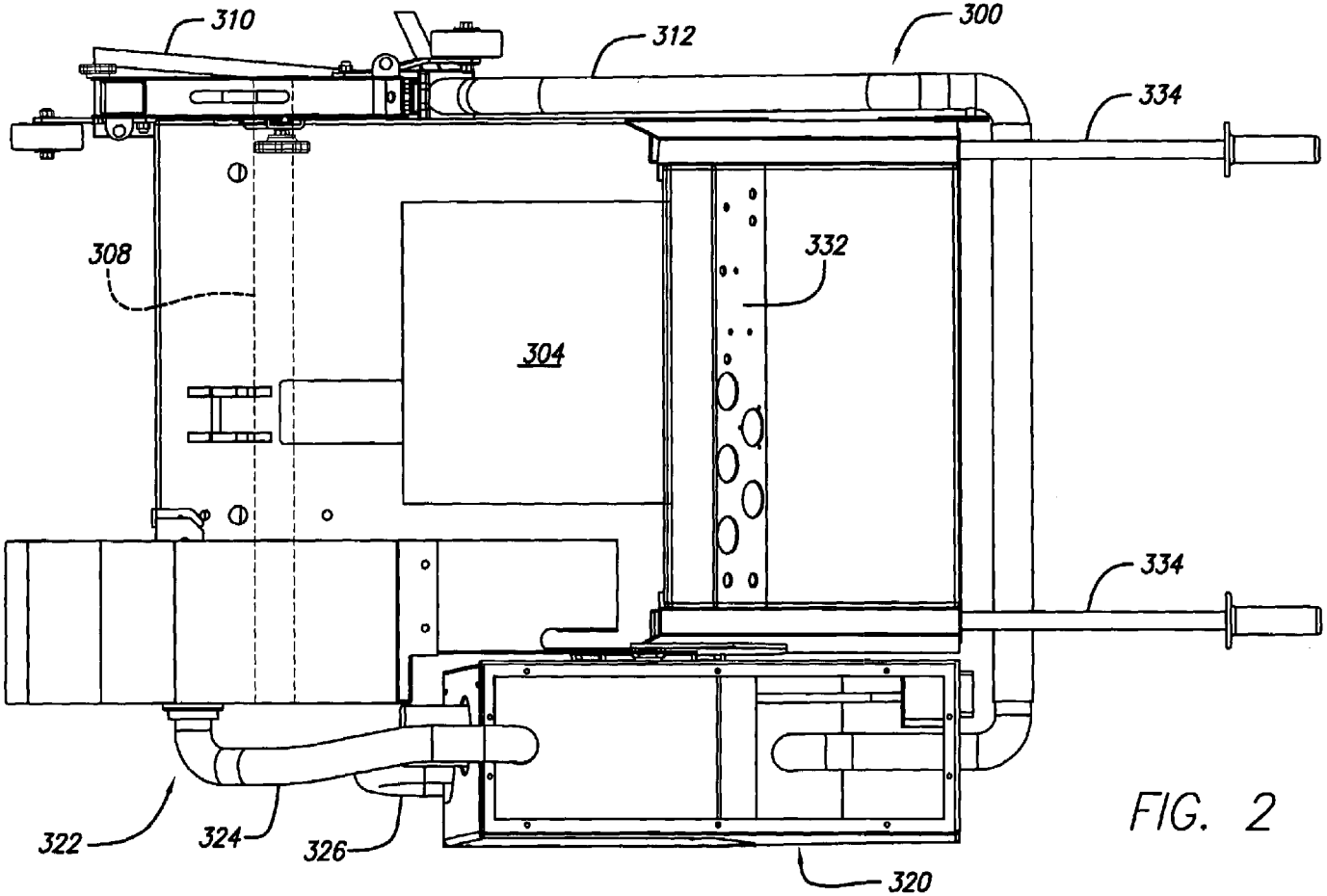
FIG. 2 is a top plan view of the saw of FIG. 1.
Figure 3:
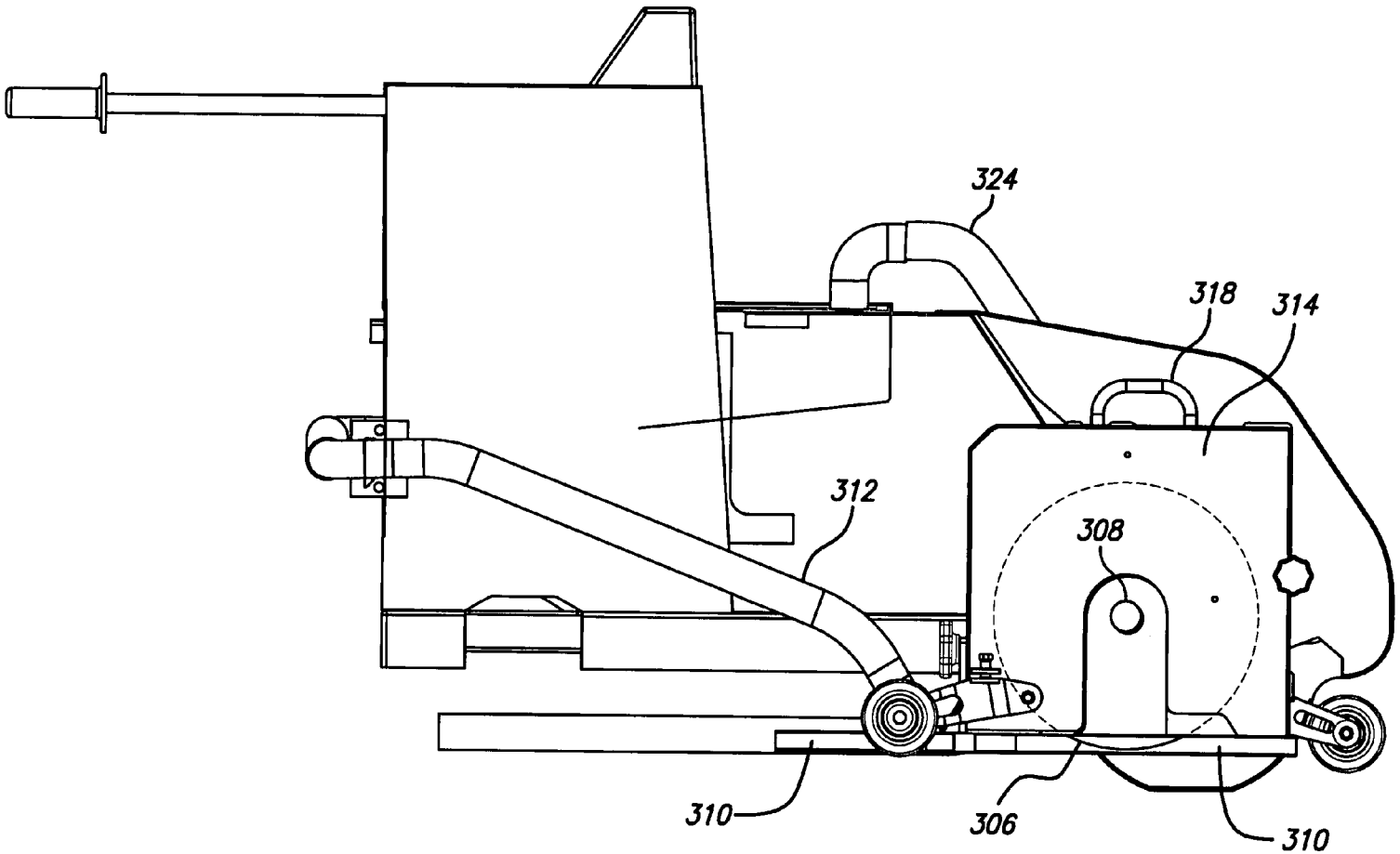
FIG. 3 is a right side elevation view of the saw of FIG. 1.
Figure 4:
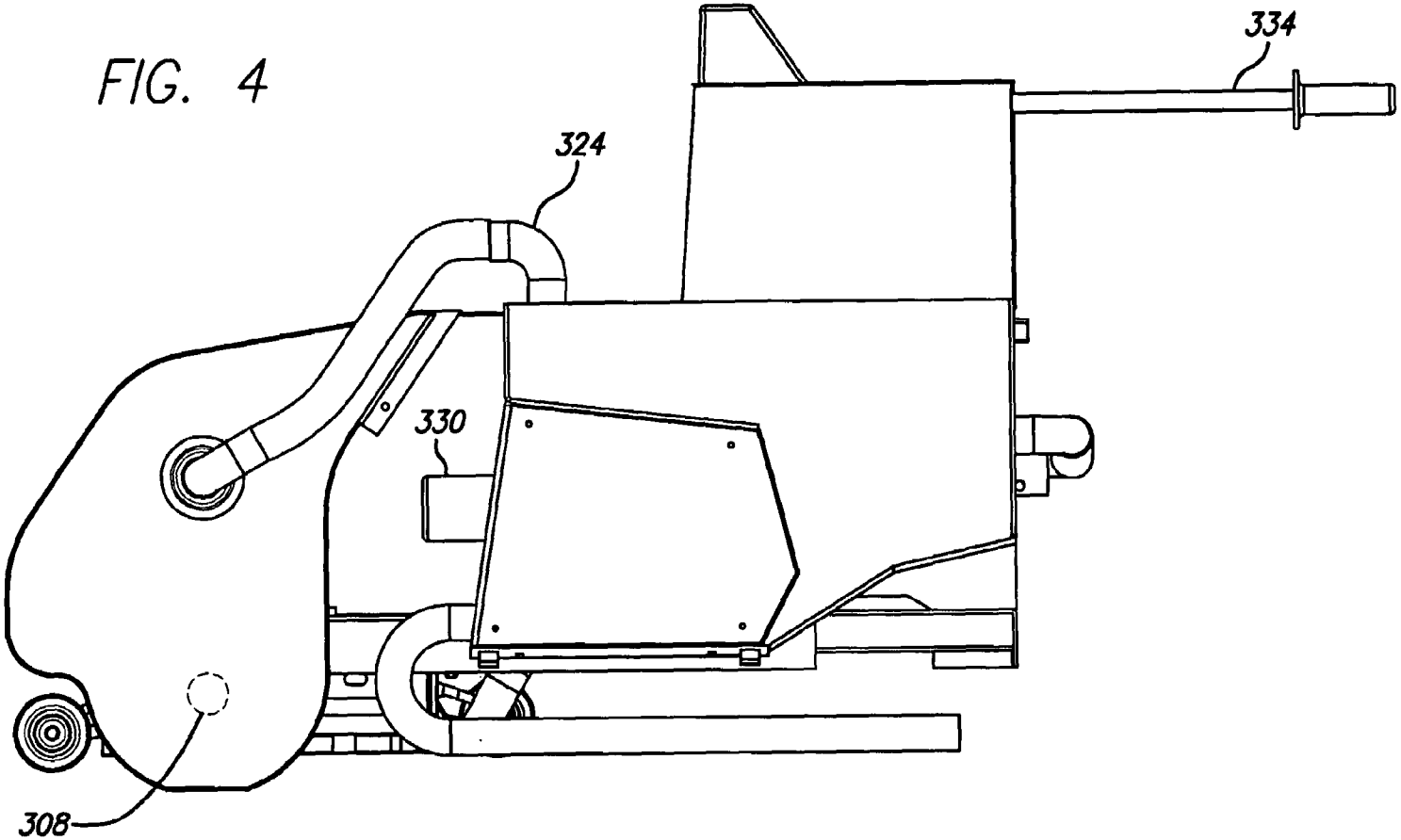
FIG. 4 is a left side elevation view of the saw of FIG. 1.
Figure 5:
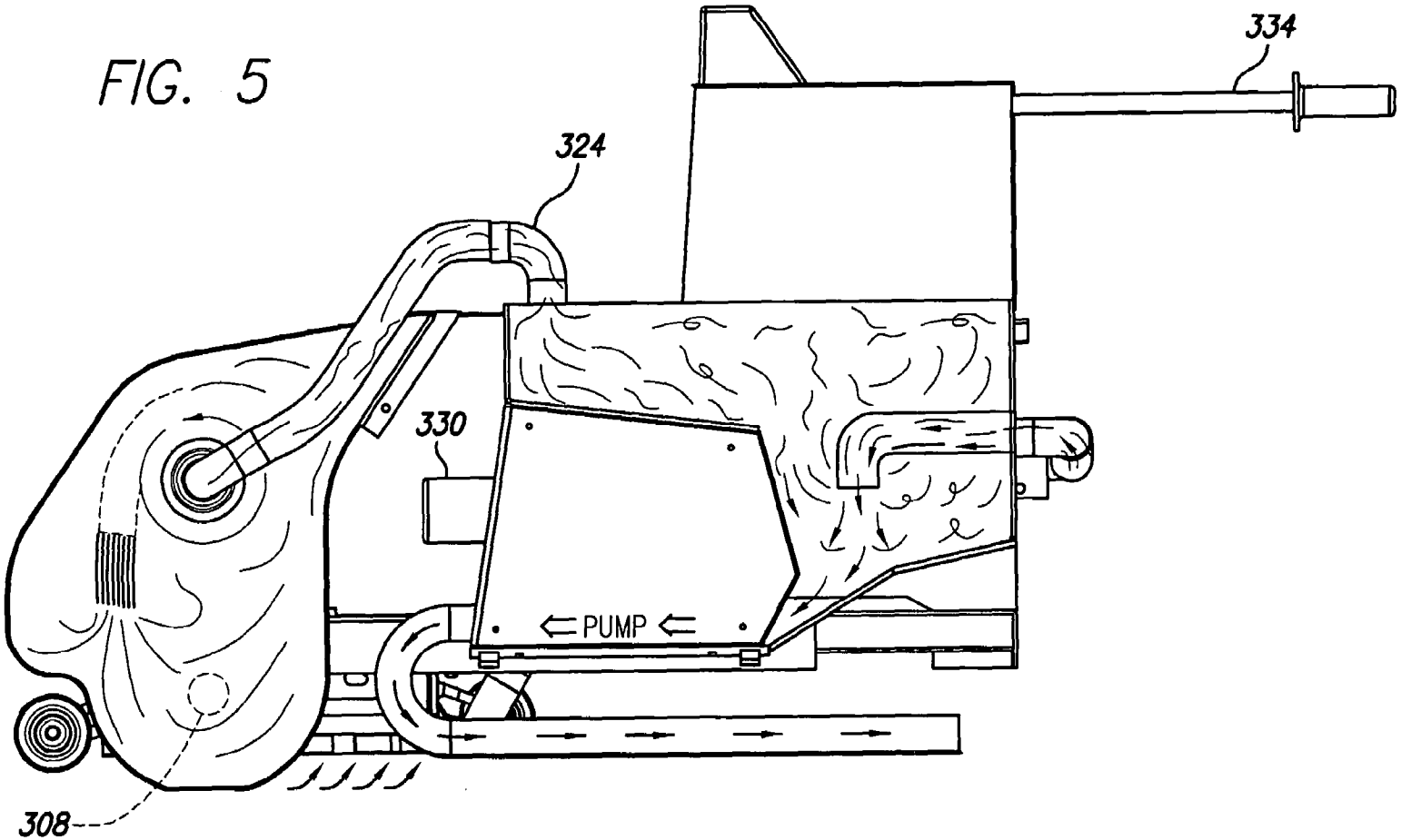
FIG. 5 is a schematic and flow diagram showing the flow of air and fluids through a waste containment system in accordance with several aspects of the present inventions.

The vacuum hose 312 extends as short a distance as possible to a slurry recovery and separation assembly 320 (FIG. 2) for transporting the slurry from the vacuum bar 310 to the assembly 320. The vacuum hose 312 is preferably raised as little as possible above the level of the vacuum bar 310 so as to use as little vacuum as possible raising the slurry to the level of the assembly 320. The assembly 320 is preferably located on a side or a surface of the saw 300 different from the right side where the blade is located so as not to obstruct the view that the operator has of the cutting area.

Vacuum is created in the assembly 320, and therefore through the vacuum hose 312 and in the vacuum bar 310, through a vacuum generator 322 coupled to the assembly 320 through a vacuum hose 324. The vacuum generator 322 is driven by the drive shaft 308, as discussed more fully below, and is controlled by the revolutions per minute (rpm) of the drive shaft. Alternatively, where the saw is electrically powered, the vacuum generator could be driven by current from the saw motor.

Figure 12:
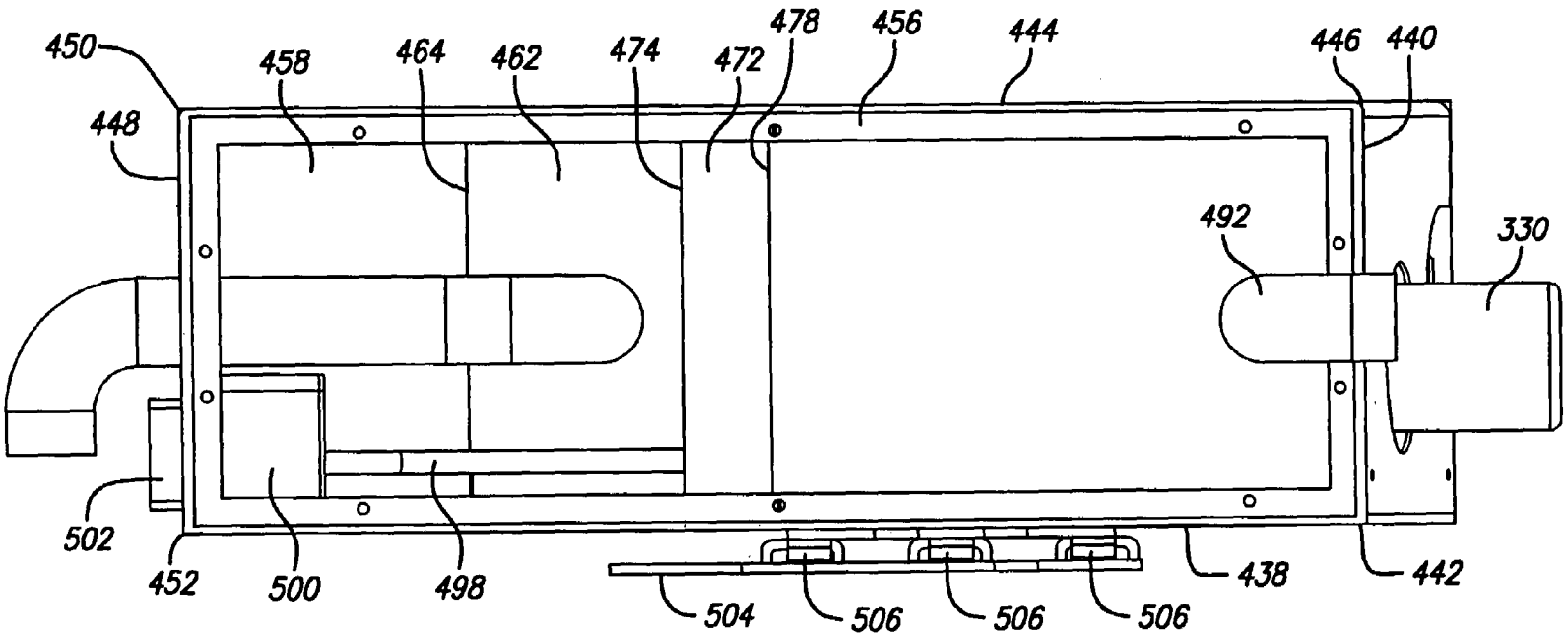
FIG. 12 is a horizontal cross-sectional view of the top of the container and pump of FIG. 10 showing the slurry input, the air output and a mounting assembly.
Figure 13:
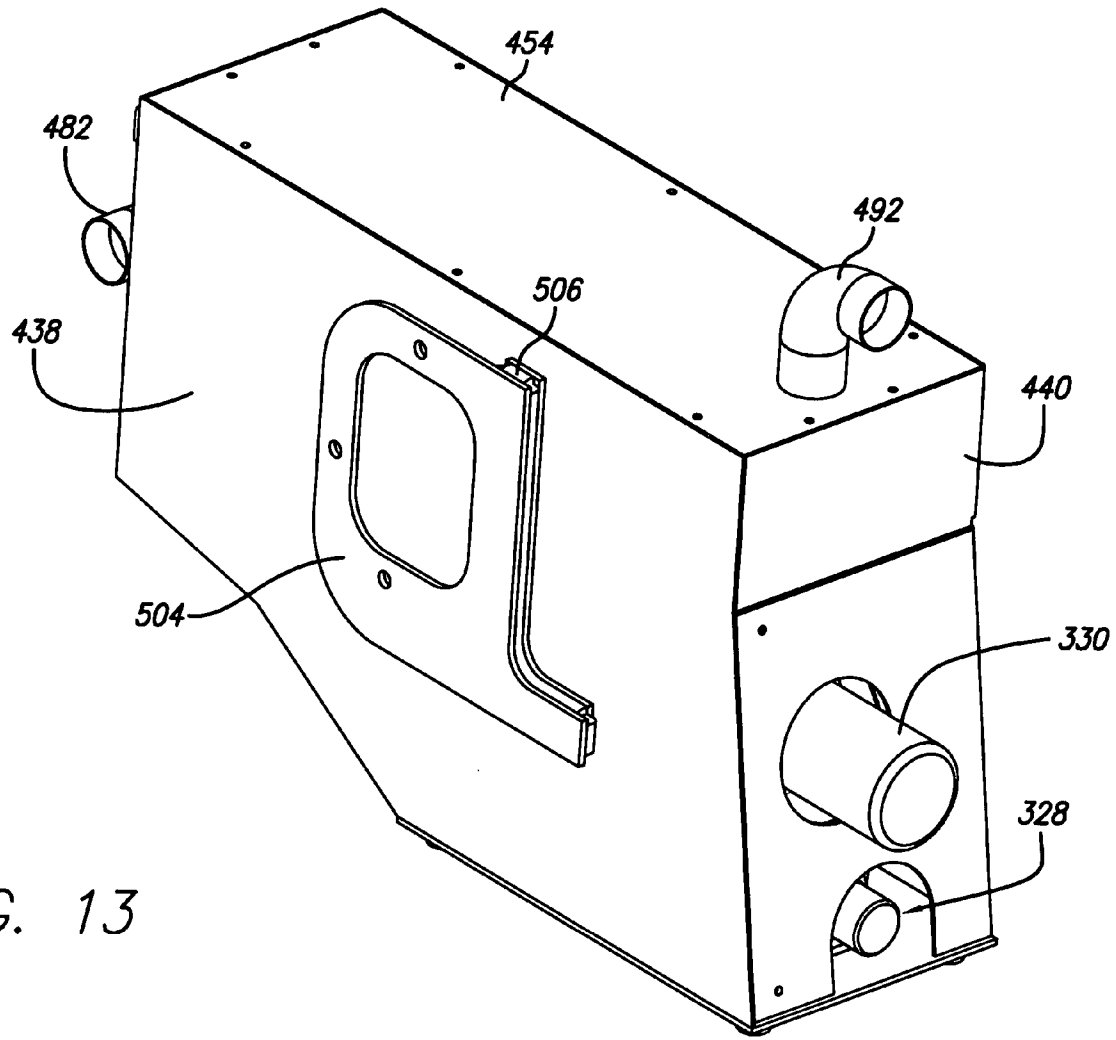
FIG. 13 is an upper right isometric view of the container and pump of FIG. 10.

Waste is removed from the assembly 320 through a waste pipe 326 through a pump 328 (FIG. 12) operated by a motor 330. The pump 328 is similar to that described in U.S. Pat. No. 5,564,408 but includes metal reinforcing on several of the moving parts of the pump. The motor 330 is preferably an electric motor driven by current developed in an alternator or generator on the engine 304. The pump also preferably includes conventional flap valves to control flow and prevent back flow on each side of the pump.

The vacuum bar 310, modified blade guard 314, vacuum hose 312, assembly 320 and the vacuum generator 322 may be factory installed or produced as components for a kit or for retrofit on existing saws. The remaining components of the saw are typical, and do not require enhancements or extraordinary modifications. Some of the other typical components of the saw are illustrated for context such as the display panel 332 and handles 334. While enhancements can be made to the basic saw to further optimize the operation, for example with larger saw blades, it is not believed that such modifications are necessary for proper operation.

Figure 6:
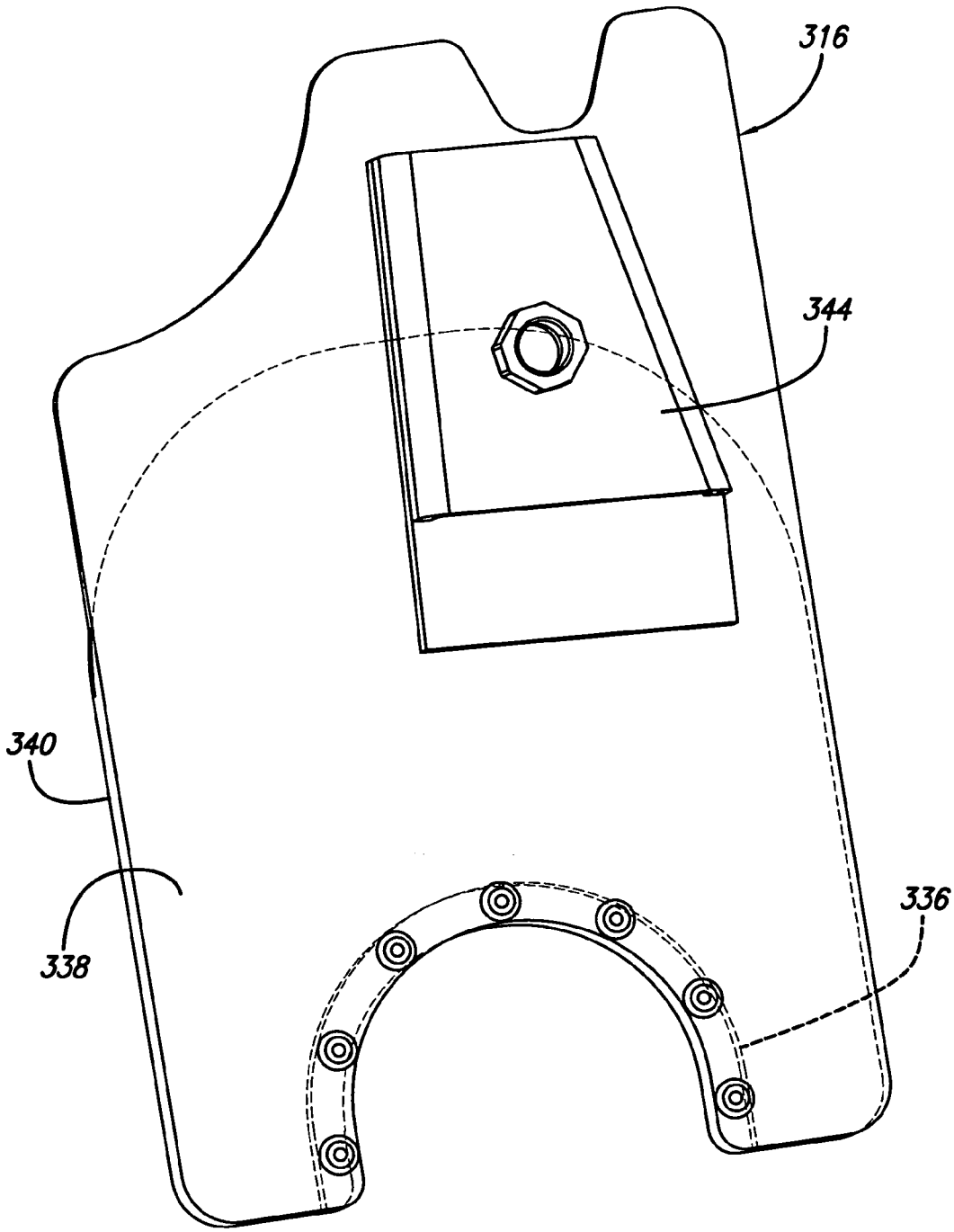
FIG. 6 is a lower left front isometric view of a blade guard support in accordance with another aspect of the present inventions.
Figure 7:
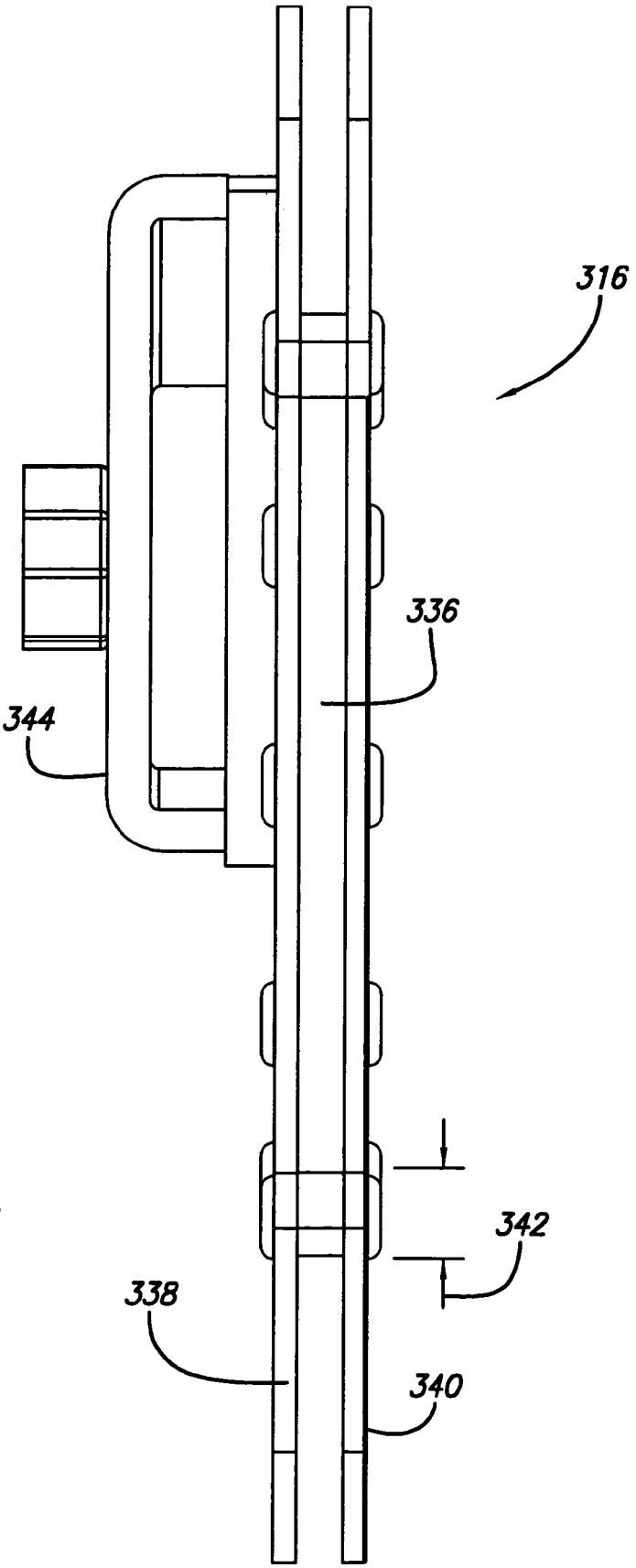
FIG. 7 is a bottom plan view of the blade guard support of FIG. 6.

The blade guard support 316 (FIGS. 1, 6 and 7) is similar to that described in U.S. Pat. No. 5,564,408, and includes a spacer 336 having a width defining the spacing between the left plate 338 and right plate 340, but also a depth 342 to provide more strength to withstand bending or buckling of the plates 338 and 340. A mounting holster 344 accepts the support element of the saw for supporting the blade guard.

The vacuum bar 310 (FIGS. 8 and 9) for picking up the slurry from around the saw blade and from grooves is similar to the vacuum bar described in U.S. Pat. No. 5,564,408 in the context of concrete saws. The vacuum bar is supported by the blade guard and held stationary relative to the blade guard by a mounting plate 346 through a mounting bolt (not shown). The position of the vacuum bar relative to the blade guard can be adjusted through the mounting bolt for adjusting the spacing between the bottom of the vacuum bar and the work surface. The preferred spacing for effective pickup of slurry from the work surface may depend on a number of factors such as the size of the vacuum bar and the number openings, as well as the vacuum developed at the vacuum bar and the surface makeup. The spacing will also depend on the uniformity of the work surface and how much large debris is created during cutting. For concrete, the spacing may be about $1/16^{th}$ (one-sixteenth) of an inch, and greater for asphalt.

Figure 9A:
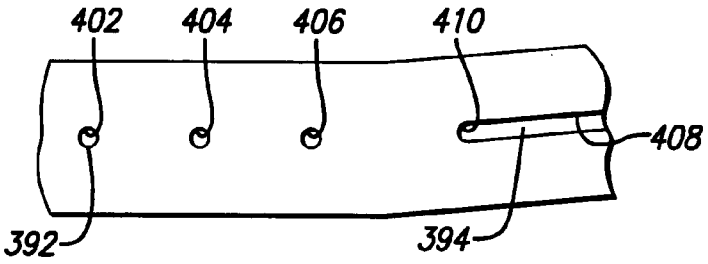
FIG. 9 is a bottom plan view of the vacuum bar of FIG. 8 showing high vacuum and low vacuum openings.
Figure 9:
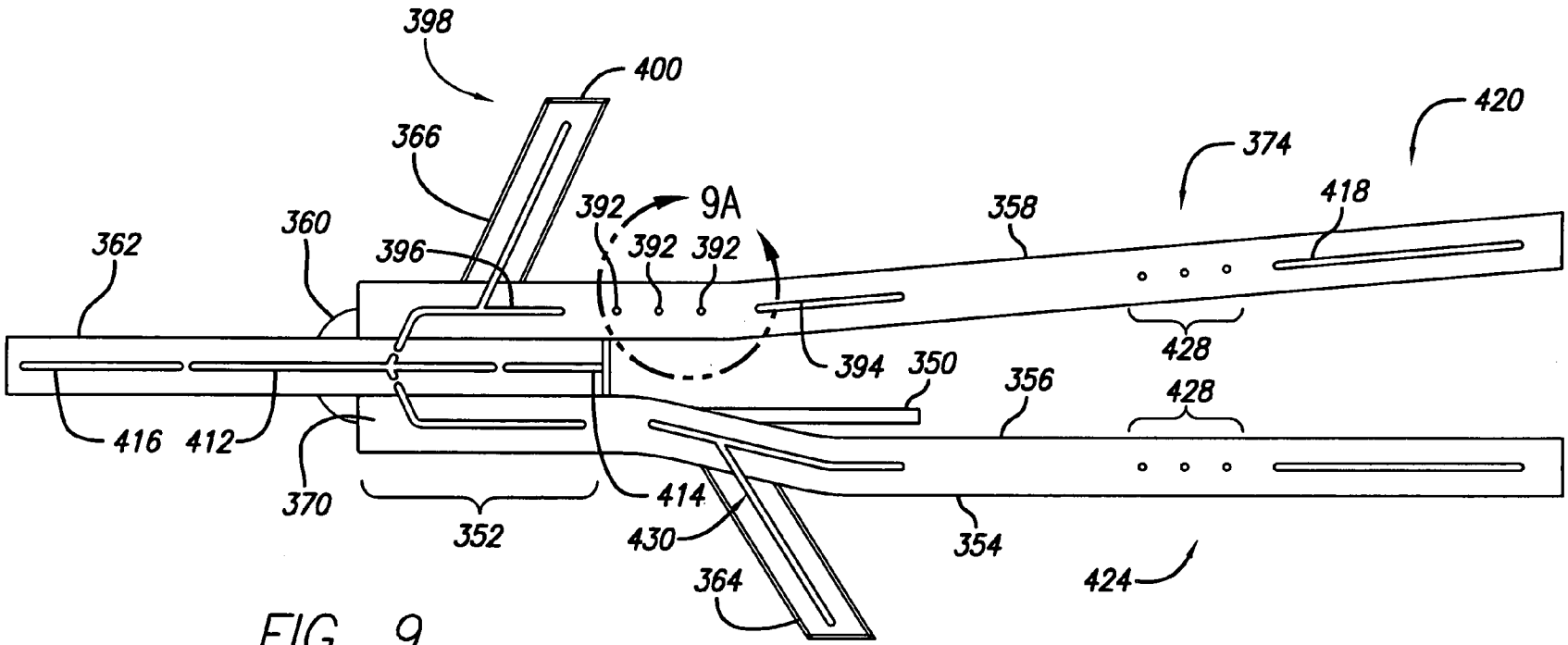
Figure 10:
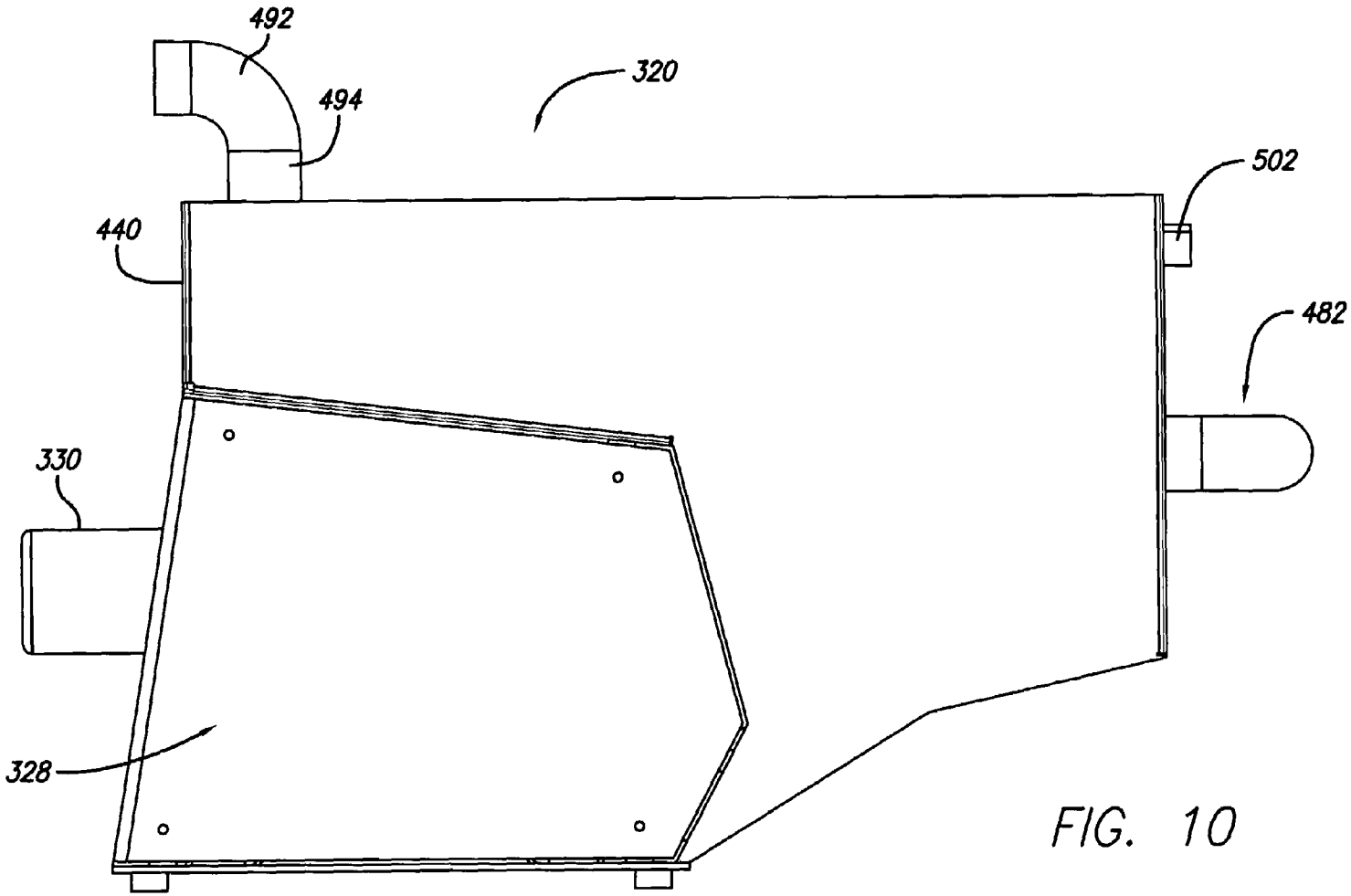
FIG. 10 is a left side elevation view of a container and pump for use with the containment system of FIG. 1.
Figure 11:
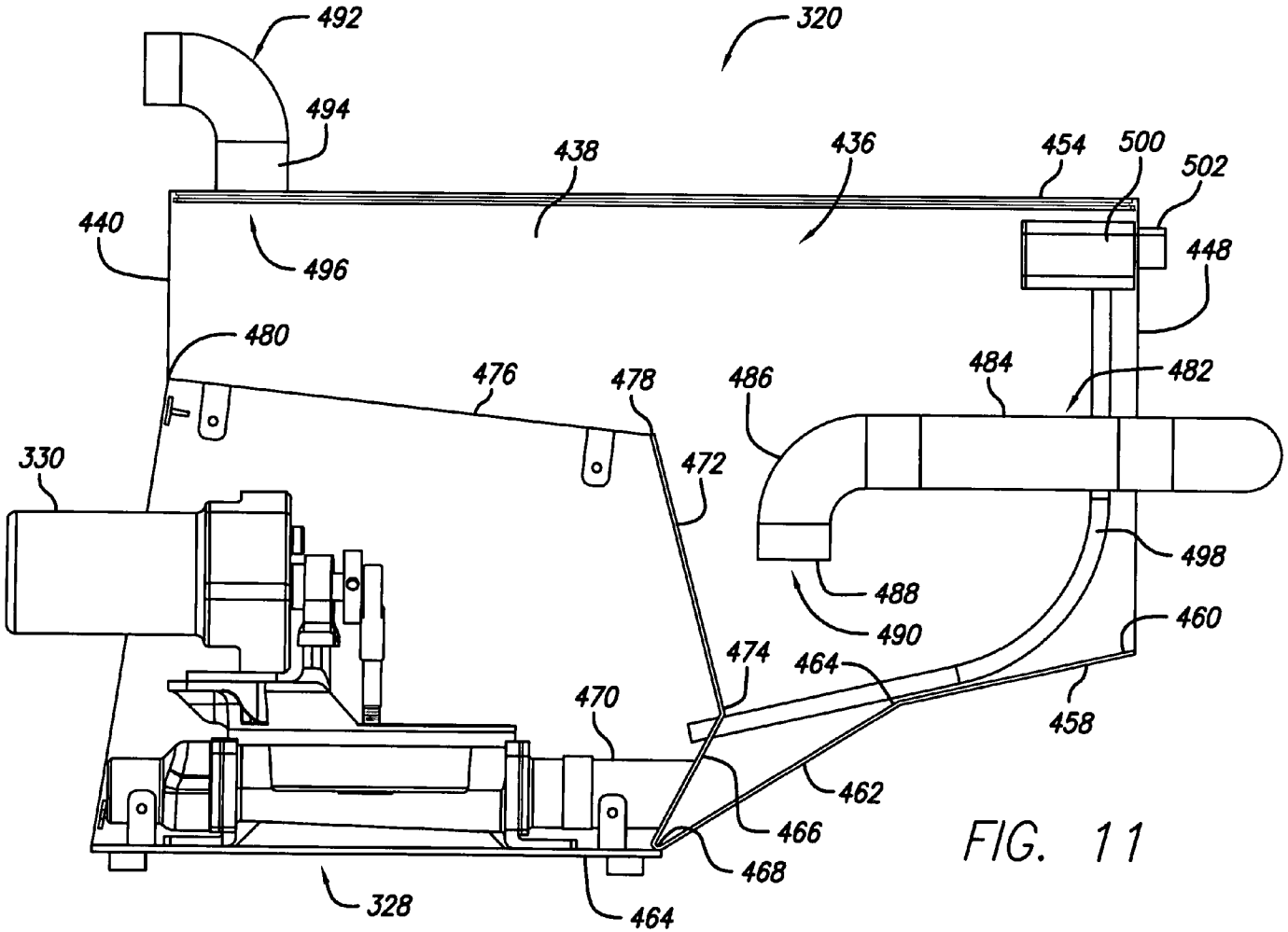
FIG. 11 is a vertical cross-sectional view of the left side of the container and pump of FIG. 10 showing an air and slurry input, a waste output and an air output.

The vacuum bar is also supported or stabilized by a left side wall 348 and a U-shaped internal blade guard wall 350. The left side wall 348 is welded or otherwise mounted to the mounting plate 346 and to the top of the vacuum bar manifold 352, as well as to the left vacuum tube 354 adjacent an inner side surface 356. The right side and rear of the wall 350 are mounted to the top surfaces of the right vacuum tube 358 and manifold 352, respectively. Part of the left side of the wall 350 is welded to the top of the left vacuum tube 354, and a remainder extends between the right vacuum tube 358 and the left vacuum tube 354 (FIG. 9). Various reinforcing walls can also be included. The vacuum coupling 360 is mounted to the top of the manifold 352 for accepting the vacuum hose 312. The tail 362 of the vacuum bar extends rearwardly from the center of the manifold 352. The left side vacuum tube 364 extends at an angle from the left vacuum tube 354 to the left side and toward the front, and the right side vacuum tube 366 extends to the right side from the right vacuum tube 358 and toward the front. The left side vacuum tube 364 joins the left vacuum tube 354 at a point forward of the manifold 352 in order to make room for other hardware on the saw.

Figure 8:
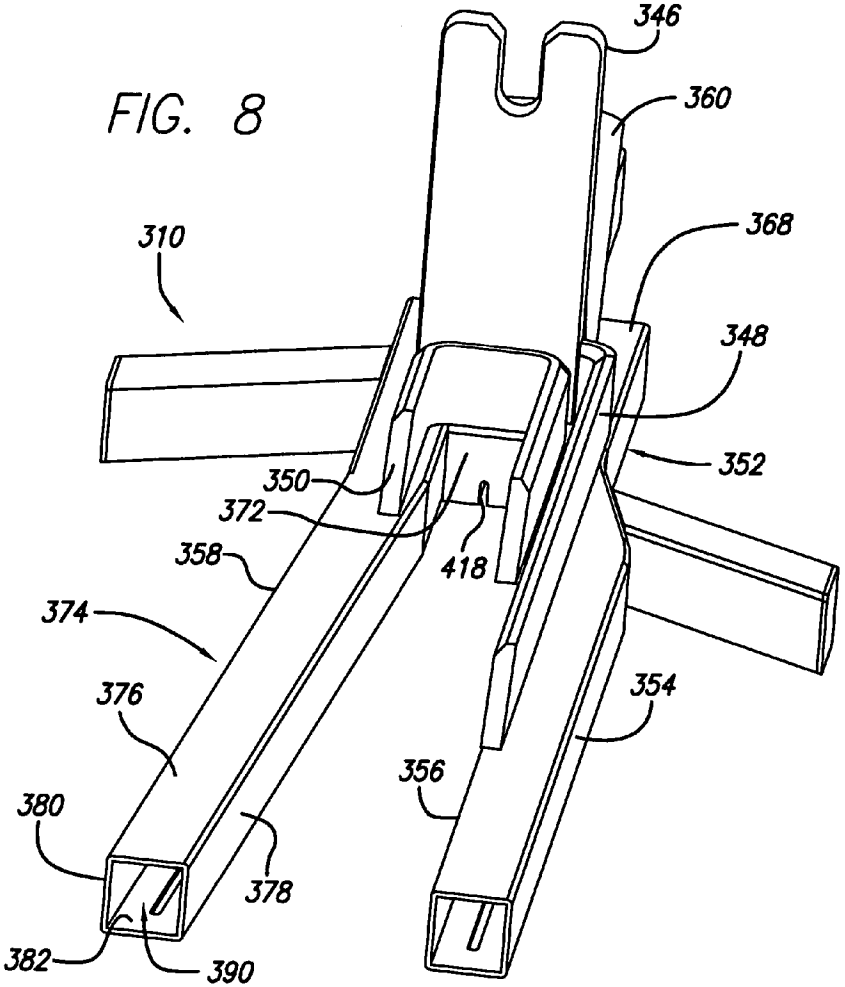
FIG. 8 is a left front isometric view of a material pickup element such as a vacuum bar in the accordance with a further aspect of one of the present inventions.
Figure 8A:
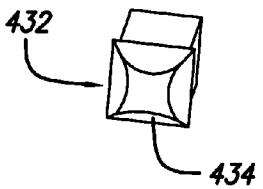

As shown in FIGS. 8 and 9, the vacuum bar 310 defines a housing beginning with the manifold 352 and having a plurality of housing walls such as the top 368 of the manifold, the bottom wall 370 of the manifold, and a front manifold wall 372. The housing of the vacuum bar also includes a first housing wall 374 defining the right vacuum tube 358 and comprising a top wall 376, a left side wall 378, a right side wall 388, and a bottom wall 382, and closed off by a preferably removable end cap (FIG. 8A). The first housing wall 374 is shown having a square, longitudinally extending configuration or cross-section defining a channel 390 closed by the end cap on one end and joining the manifold at the other end adjacent the forward wall 372. Other configurations are possible, but a square cross-section is preferred to enhance pickup and transport of the slurry. The other vacuum tubes are also preferably square in cross-section.

The bottom wall 382 includes a plurality of opening walls defining a plurality of apertures passing through the bottom wall 382 to permit a pressure differential across the bottom wall between the channel 390 and the outside of the tube 358 when vacuum is applied to the vacuum coupling 360. The plurality of apertures includes at least one low vacuum aperture 392 and at least one high vacuum aperture 394. The high vacuum aperture picks up most if not all of the slurry in its region and the low vacuum aperture focuses, collects concentrates or aligns the slurry so that it can be more easily picked up by a high vacuum aperture, typically a different high vacuum aperture. Some pickup may occur with the low vacuum apertures. It is believed that the low vacuum apertures center or bring in fluid from both sides of the vacuum bar so that it can be picked up by a high vacuum aperture following behind. For example, a trailing high vacuum aperture 396 generally aligned with the preceding low vacuum apertures 392 will pickup the slurry gathered by the apertures 392. The trailing high vacuum aperture 396 is formed in the bottom wall 370 of the manifold. Additionally, though not necessarily, a side high vacuum aperture 398 formed in the bottom surface or wall 400 of the right side vacuum bar 366 may also pickup slurry gathered by the low vacuum apertures 392. It should be noted that aperture 398 will also pickup water splashed away from the saw blade, which would not typically include any particulates generated during cutting.

Figure 18:
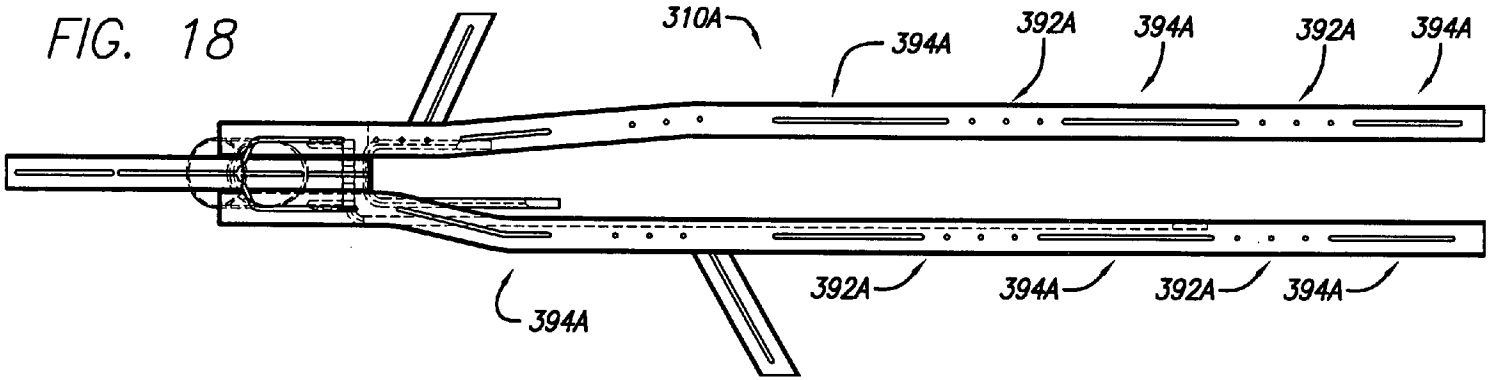
FIG. 18 is a bottom plan view of a vacuum bar having a further arrangement of openings.
Figure 19:
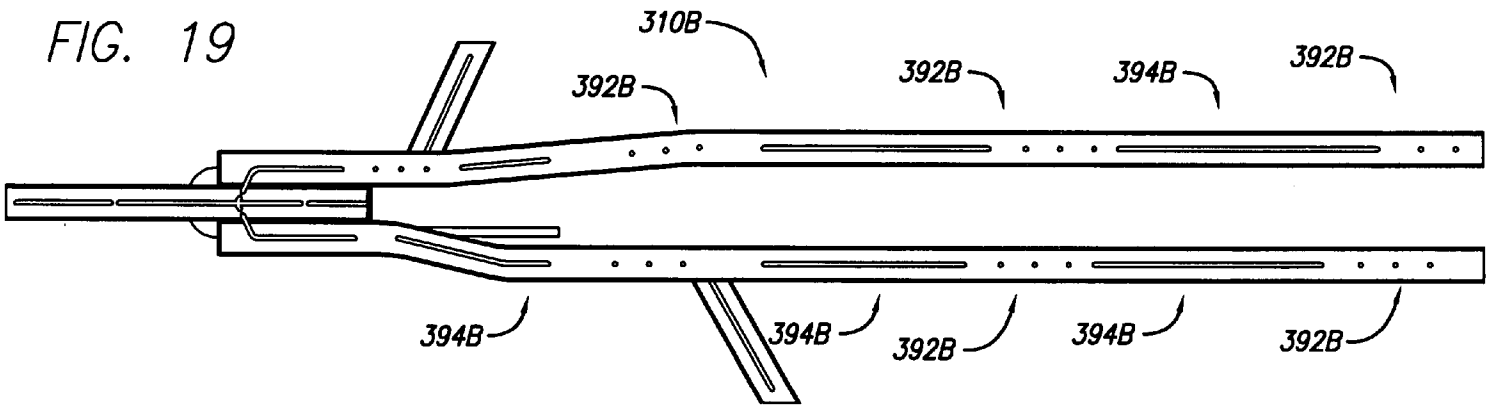
FIG. 19 is a bottom plan view of a vacuum bar having another arrangement of openings.

Using high vacuum and low vacuum apertures helps to conserve vacuum pressure or minimize the loss of vacuum through larger openings, especially where the amount of vacuum available may be limited by the size of the saw, available horsepower, and the like. They are also helpful, for a given size of saw, where larger blades are used in place of smaller blades. With a larger blade, the vacuum bar 310 is longer in overall dimension, preferably extending at least to the front of the blade guard if not further forward. For a given saw, a 30 inch blade would preferably include a vacuum bar 310A (FIG. 18) that was about 44 or 45 inches long, whereas the suction bar shown in FIGS. 8 and 9 was designed for a 16 inch blade and is about 27 or 28 inches long. A 26 inch blade would preferably include a vacuum bar 310B (FIG. 19) that was about 38 or 40 inches long. Additionally, having both low and high vacuum apertures allows positioning of the high vacuum apertures at locations of high slurry and/or water production, and positioning of low vacuum apertures elsewhere where high vacuum is not as important. Nonetheless, the low vacuum apertures still help to collect the slurry to be picked up by a following or trailing high vacuum aperture.

In one preferred aspect of the present inventions, the low vacuum apertures are round or similarly shaped holes having walls 402, 404 and 406. The holes are preferably formed straight through the bottom wall 382 of the housing 374 perpendicular to the surface of the housing. However, the configurations of the holes can be different, as well as different from each other, in size, shape, positioning and orientation. For example, the low vacuum holes can be arranged in a series such as those shown in FIG. 9, aligned with one another, and also aligned with the end of the high vacuum aperture 394. The first one or several low vacuum holes, for example, can be the same size while following holes toward the rear of the vacuum bar can be larger in size, and therefore higher in vacuum. Conversely, they can decrease in size in the same direction. Additionally, the apertures can be placed other than in the center of the bottom wall 382.

In another preferred aspect of the present inventions, the high vacuum apertures are extended slots defined by substantially straight walls 408 joined by substantially circular end walls 410. The high vacuum apertures are also preferably formed straight through the bottom wall 382 of the housing 374 perpendicular to the surface. As with the low vacuum apertures, the high vacuum apertures can be different as well as different from each other in size, shape, position and orientation, and may vary in size from one end to the other of an individual slot.

The apertures, such as the high vacuum apertures, can be curved such as the high vacuum apertures 396 in the manifold 352. They also can have other shapes. The aperture 396 extends almost the entire length of the manifold and curves toward longitudinal center line of the manifold. Additionally, as can be seen in FIG. 9, a high vacuum aperture such as 396 can be formed from two or more openings, including 398. A second high vacuum aperture 412 may be formed from a long slot and two oppositely extending short slots. Additional high vacuum apertures 414 and 416 are preferably formed in the bottom wall 370 of the manifold and the bottom wall of the tail 362 of the vacuum bar, respectively, preferably aligned with the plane of the saw blade to remove slurry not only from the work surface but also the groove just cut.

The high vacuum aperture 414 is formed from a slot in the bottom 370 in the manifold and from a slot 418 (FIG. 8) formed in a vertical forward wall 372 of the manifold. As can be seen, a high vacuum aperture can be formed in two different surfaces of the vacuum bar. The slot 418 can be formed as its own high vacuum aperture positioned directly behind saw blade to pickup material thrown up by the saw blade. However, it is believed that a continuous high vacuum aperture formed by the slot 418 and the slot 414 is more effective at picking up slurry immediately behind the saw blade. The slot 418 can be wider than the other high vacuum slots, as can other high vacuum slots immediately behind the blade, or they can be the same width.

The first housing wall 374 may also include an additional high vacuum aperture 418 at a forward portion 420 of the first housing 374. The aperture 418 would be the forward-most aperture on the right side of the vacuum bar to be able to pickup water or slurry from the work surface. In the preferred embodiment, three low vacuum apertures 422 are positioned close behind and aligned with the high vacuum aperture 418.

In the preferred embodiment, the left vacuum bar 354 forms a second housing element 424 in fluid communication with the manifold and the first housing wall 374, extending forward of the manifold and slightly divergent from the first housing wall 374. The second housing element 424 also preferably includes a forward high vacuum aperture 426 to be the forward-most high vacuum aperture on the left side of the vacuum bar. It also includes a set or series of low vacuum apertures 428 preferably aligned with and rearward of the high vacuum aperture 426. An additional high vacuum aperture 430 may be formed between the low vacuum apertures 428 and the manifold 352.

As can be seen in FIG. 9, the high vacuum and low vacuum apertures can alternate and can be aligned with respect each other, preferably in the general direction of travel of the vacuum bar. The openings are preferably distributed over the vacuum bar so as to take advantage of the forward or backward motion of the saw. The different openings promote more even flow of the slurry relative to the vacuum bar and conserve vacuum pressure. The high vacuum and low vacuum apertures may alternate between a single large opening and a series of small openings, again followed by a large opening. The actual distribution, configuration and arrangement of the different apertures may be determined by a fluid dynamics computer program based on various input parameters, including available vacuum or suction, viscosity, desired flow rates, and the like. The openings are also given, typically, and the system works iteratively to develop possible solutions. While most of the apertures open downwardly from the bottom of the vacuum bar toward the work surface, at least one aperture 414 includes a portion (slot 418) that extends vertically, opening or facing other than downwardly. In one preferred embodiment, the low vacuum apertures are 0.125 in. in diameter (less a few thousandths of an inch for a powder coating on the vacuum bar) and separated from each other by about 0.750 in. They are preferably arranged in series of three. The width of the high vacuum apertures is preferably 0.125 in., and their length may range from less than an inch to several inches, depending on the length of the vacuum bar. The vacuum bar for a 16 in. saw blade can have high vacuum aperture lengths up to four or five inches or more for vacuum developed with a conventional saw with the system described herein.

FIG. 8A shows a bull-nosed end cap 432 for closing off the forward ends of the left and the right vacuum tubes and the rearward end of tube 362. The bull nose shape includes curved surfaces 434 for more easily negotiating or riding over pebbles or other objects which may be in the line of travel, such as created during cutting. The end caps are removable for easier cleaning of the vacuum bar.

The slurry recovery and separation assembly 320 (FIGS. 10–13) separates the air from the water coming from the vacuum hose 312, and therefore removes abrasive material from the air. Other damaging materials may also be present in the slurry, which are preferably removed from the air. The assembly 320 preferably includes a fluid-tight receptacle, container, canister or tank 436 for receiving a combination of the air and slurry, and including at least two vertically extending walls, such as right side wall 438 and front exit wall 440. The two walls meet and join at a vertically extending 90 degree angle 442 so that the potential for the air and slurry within the tank 436 to rotate or create a cyclone-type motion is reduced. The left side wall 444, similar in shape to the right side wall 438, also extends vertically and joins the front exit wall 440 at a vertically extending angle 446. Both of the left and right side walls meet and join a back inlet wall 448 at respective vertically extending angles or corners 450 and 452, respectively. The tank 436 is closed by a top or cover 454 which joins the respective side walls at 90 degree angles at a support flange 456 extending around the perimeter of the tank. It is removable for easy cleaning of the tank. The tank 436 preferably does not have a flat, horizontal bottom, to reduce splashing. The remaining walls between the left and right side walls are generally square or rectangular, join the respective side walls at 90 degree angles, preferably, but are arranged more or less horizontally or vertically as a function of location relative to an inlet or an outlet.

The back inlet wall 448 extends vertically a substantial portion of the height of the tank 436. The bottom joins a first shelf plate 458 at an angle 460 of approximately 100 degrees for allowing liquid to flow down the first shelf plate 458. The first shelf plate 458 slopes to a lower shelf plate 462. The first shelf plate 458 and the lower shelf plate 462 join at an angle 464 of approximately 200 degrees to minimize upward splashing of slurry, and to move slurry down to the bottom of the lower shelf plate 462 where it collects. The lower shelf plate 462 ends at and is supported by a pump support plate 464 and joins a slurry outlet plate 466 at an angle 468 of approximately 30 degrees, a small acute angle. This angle is relatively small so as to effectively retain the slurry in the relatively narrow bottom until it is pumped out by the pump 328 through a slurry outlet 470 located close to and connected to the pump by a short tube of about several inches. The slurry outlet plate 466 extends upwardly and rearwardly to approximately the same level as angle 464, where it joins a riser plate 472 at an angle 474 of approximately 223 degrees. The angle 474 is preferably greater than 180 degrees so as to increase the volume of the mid-level portion of the tank, or that portion of the volume of the tank between angle 474 and the top of the riser plate 472 and the back inlet wall 448, while still presenting a splash plate or wall tending to keep the slurry and any excess water between plates 462 and 466. The riser plate 472 is preferably at about a 15 degree angle from the vertical to provide a vertically extending wall for minimizing splashing while still providing an increasing volume in the upward direction and interrupting any direct line of air flow from the inlet to the air outlet. The riser plate 472 extends away from the back inlet wall 448 to allow air to travel more easily upward and away from the slurry.

The riser plate 472 joins an upper shelf plate 476 at an angle 478 of approximately 249 degrees. The upper shelf plate 476 extends forward to vertical front exit wall 440 where they join at an angle 480. The upper shelf plate 476 provides the base portion of the upper approximate one-third of the tank, measured vertically. The upper third of the tank preferably contains almost all air and very little moisture or slurry. The intermediate approximate one-third of the tank, measured vertically, will have a substantial portion of air and some water or slurry. The lower one-third, measured vertically, preferably has almost exclusively slurry. The depth of the slurry is preferably about 3 to 3½ *inches*.

The tank includes an inlet 482 for receiving a combination of air and slurry from the vacuum hose 312 and allowing the combination of air and slurry to flow into the tank. The inlet passes through the back inlet wall 448. The inlet 482 is preferably a relatively rigid tube or pipe 484 and extends a substantial distance from the wall 448 toward the riser plate 472 to a 90 degree elbow 486. The elbow 486 terminates in a wall 488 defining an opening 490 preferably facing directly downward toward lower shelf plate 462 for allowing the slurry to drop straight down. The opening 490 is preferably positioned below the upper shelf plate 476 so that there is no direct line of air flow between the opening 490 and the air outlet. The opening 490 as well as the rest of the inlet 482 are preferably two inches in diameter and may pass an approximately 3:1 ratio of air to slurry by cross-sectional area at about 200 cubic feet per minute. The opening 490 is positioned significantly below the upper shelf plate 476 so that the water and slurry are input well below the upper third of the tank. The inlet 482 is preferably centered between the left and right side walls. Additionally, the slurry is preferably input closer to the riser plate 472 than to the inlet plate 448 so that the slurry travels as little as possible before reaching the bottom of the tank and the slurry outlet 470. The opening 490 is preferably high enough above the slurry level that vacuum is still created in the vacuum line 312 without creating turbulence on the surface of the slurry at the bottom of the tank, while at the same time minimizing the height that the slurry must be raised from the suction bar to the inlet 482.

A second, air outlet 492 removes air from the tank 436 thereby creating a vacuum within the tank, which creates a vacuum within the vacuum hose 312 for producing suction in the suction bar 310. The air outlet 492 is preferably centered between the side walls and located close to the air outlet wall 440 and a significant distance from the slurry in the bottom of the tank. The air outlet is not located on any line or plane of symmetry other than between the two side walls thereby reducing the possibility that air being removed from the tank is part of a channel of air flow. The air travels a significant distance through the tank to reach the outlet, and does not have a direct line of travel between the opening 490 and the outlet 492. The outlet 492 includes a wall 494 for defining an opening 496 which is preferably flush with the top 454 of the tank.

The separation tank promotes organized control of the slurry and disorganized or uncontrolled flow of air within the tank. The irregular surfaces and discontinuous walls in the tank reduces cyclone-type fluid flow within the tank which would tend to keep moisture and particulates carried in the air. The inlet is placed close to the slurry or other material outlet and close to a wall to help contain the material flow. Residual splashing is minimized as much as possible by interrupting any straight or parabolic air path and any air flow channels, and reducing symmetries of surfaces within the tank, while encouraging a gentle gradient of air flow from the area of the inlet portion of the tank to the outlet portion of the tank. Additionally, it is preferred to minimize the amount of directional change of the air and slurry coming out of the opening 490. It is also preferred to place the inlet opening far enough away from any given surface to minimize funneling or channeling of air upward past the opening 490. One measure of one preferred inlet position is to have a relatively large change in cross-sectional area going from the opening 490 into the open tank and reducing the velocity of the air and slurry mixtures. Additionally, a large total volume for the tank is preferred.

Some exemplary approximate dimensions for the separation tank have the width equal to about 9 and ½ in. and the overall length about 27 inches. The inlet wall is about 12 inches high and height from the pump support plate 464 to the top of the tank is about 18 inches. The plate 440 is about five inches high, the plate 476 about 13 inches long and the plate 472 about eight inches long. The plate 466 is about four inches long and the plate 462 about eight inches long. The plate 458 is about seven inches long. The length of the inlet 482 from the center of the opening 490 to the outer most point of the pipe outside the tank is about 13 and ½ inches. These dimensions give a tank having a low height, large volume and a relatively large transition from the inlet pipe to the tank.

A level indicator or overflow alarm (not shown) can be included to indicate when the level of slurry reaches a selected level. Other indicators and safety features can be included as desired to make easier becoming familiar with a machine and for using the machine.

Power to the pump 328 is provided by a sealed conductor 498 extending from a fast hook-up and disconnect junction and switch box 500, mounted at the inlet panel. 448, to the pump 328. The conductor extends through a sealed opening in the panel 466. A shut-off switch 502 can be used to start or stop the pump.

Figure 14:
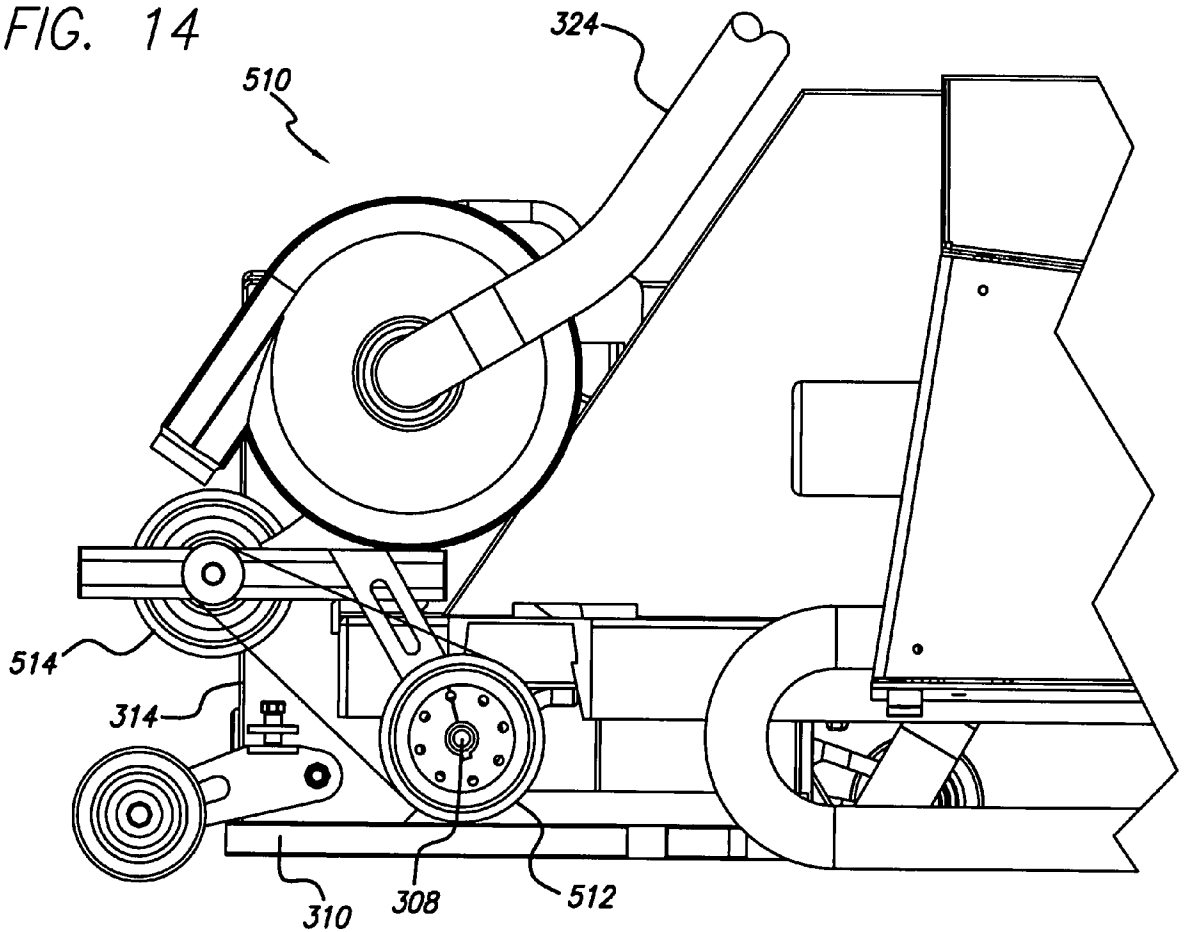
FIG. 14 is a partial left elevation view of the saw of FIG. 1 showing a vacuum generator and its drive mechanism.

A mounting plate 504 (FIGS. 13 and 14) can be fastened to the side of the saw so that the separation tank and pump assembly can be removably mounted to the saw through hooks or other brackets 506. The plate and hooks are preferably configured to insure that the separation tank and pump assembly maintain a center of gravity for the tank.

Figure 15:
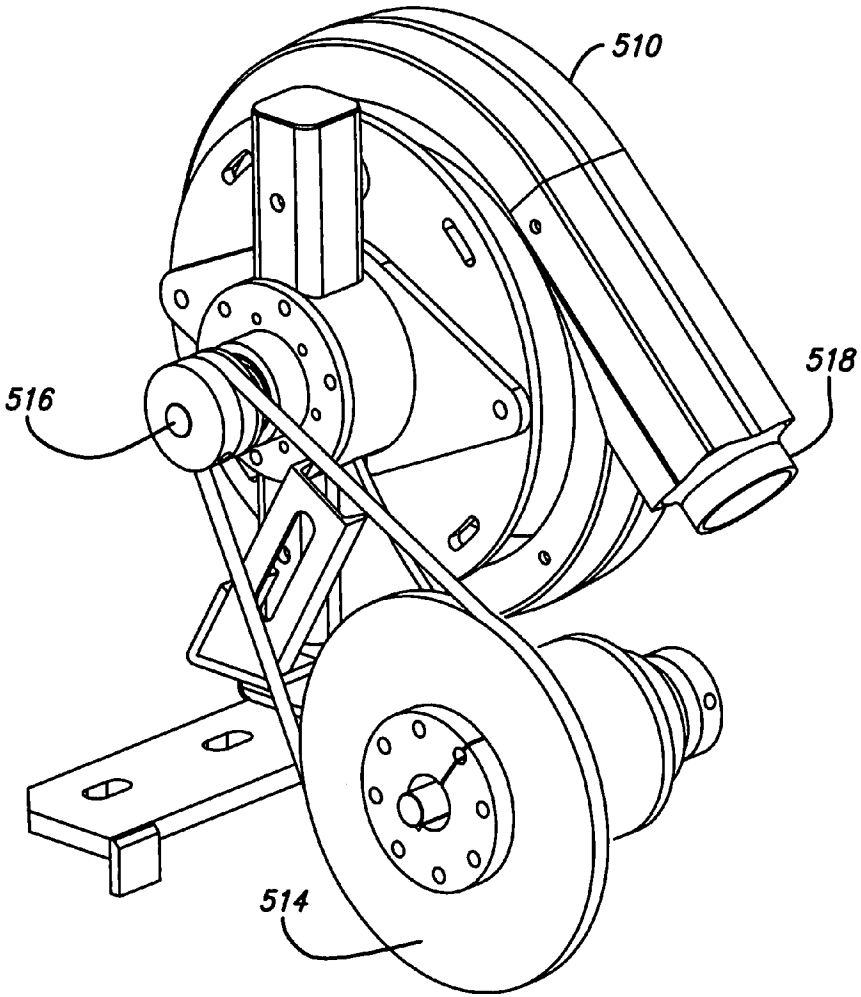
FIG. 15 is a right side isometric view of the vacuum generator and its drive transmission assembly and mounting assembly.
Figure 16:
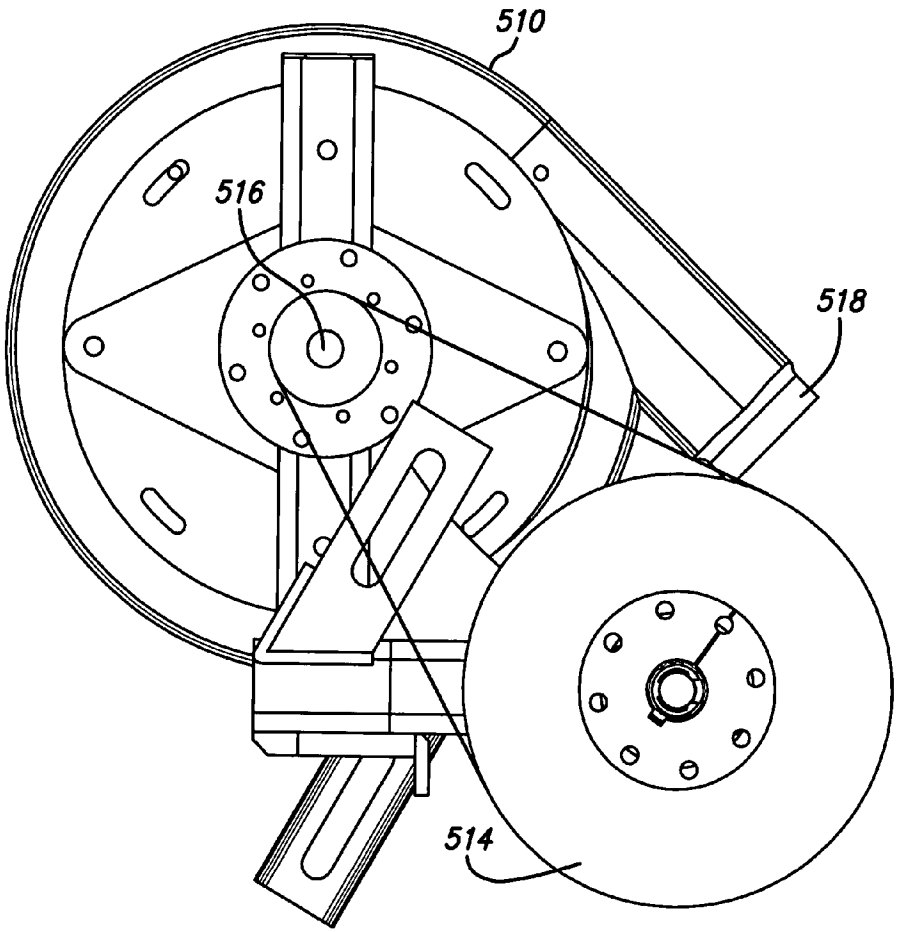
FIG. 16 is a right side elevation view of the assemblies of FIG. 15.

The vacuum generator 322 includes a housing 508 (FIG. 1) for containing an impeller or fan 510 (FIGS. 15–17) for creating a vacuum in the tank. The fan may be a Breuer Electric Mfg. Tornado with a number 12692 impeller capable of generating at least 180 to 184 cubic feet per minute of flow, or more, at 16,500 rpm through a two inch diameter orifice. The fan is preferably rated for fifty-one inches of static water lift. The fan chamber part number 12642 and the fan chamber plate part number 11237 are also included. The fan is driven off of the saw blade drive shaft 308 through a pulley 512 which drives a second pulley 514, which in turn drives the shaft 516 of the fan. The fan exhaust 518 is directed into the housing 508 for cooling the high speed bearings and/or components of the saw.

The fan and two idlers (one for each drive belt, not shown) are each supported by two high speed, long life and lifetime lubricated bearings mounted, supported and protected on the saw frame by suitable supports. The bearings are preferably rated for at least the 16,500 rpm operating conditions, and preferably higher. The preferred bearings are SKF Mfg. number 6202-2Z/C3HT bearings rated for 29,000 rpm.

Figure 17:
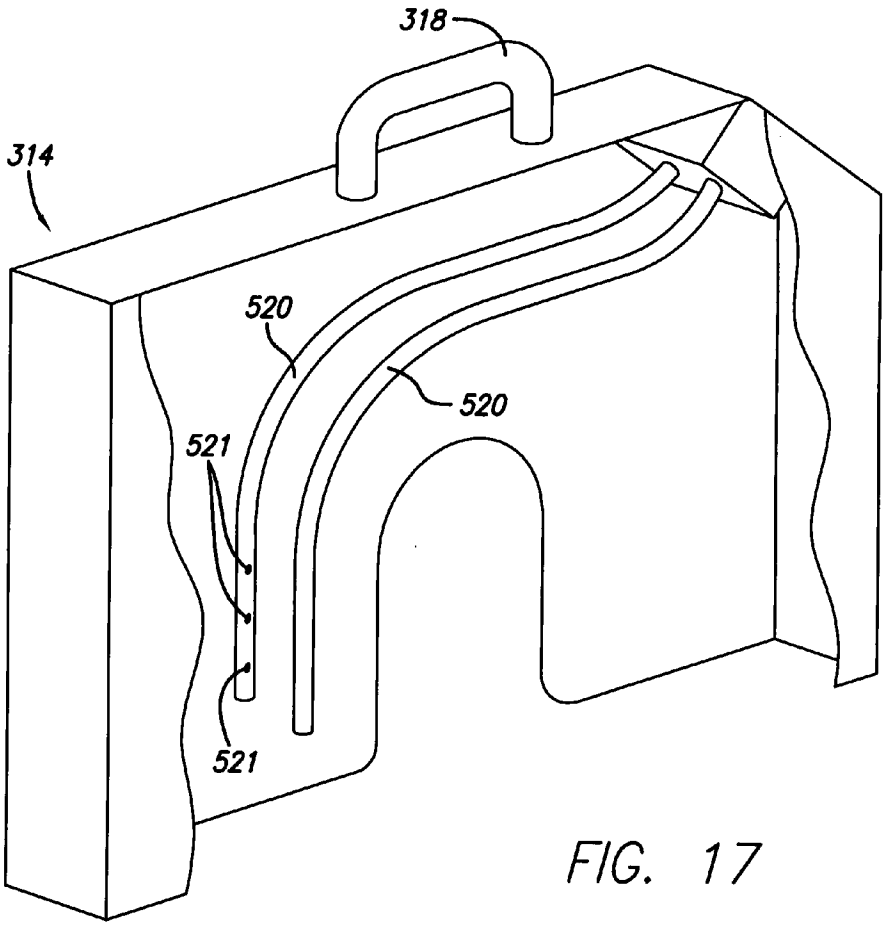
FIG. 17 is a side elevation view and partial cut-away of a blade guard showing water tubes for wetting the saw blade.
Figure 17A:
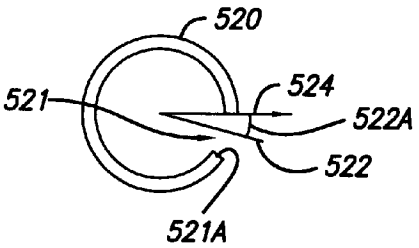
FIG. 17A is a detail of a water tube of FIG. 17.

The tool guard such as the blade guard 314 includes a water supply conduit or tube 520 for projecting or spraying fluid onto the saw blade (FIG. 17). The water is directed toward the tool at an angle different than 90 degrees. For example, the water can be directed backward toward the rotationally-advancing side of the blade. Directing the water backward relative to the rotation of the blade reduces the amount of water thrown forward of the blade. Consequently, the amount of water to be picked up at the front of the blade is reduced. In one preferred embodiment, the water is directed backward at an angle 522 of about three degrees from a line 524 perpendicular to the blade.

By including a vacuum generator on the saw driven by the saw engine or other power supply, the components of the saw can still be part of a self-contained unit. The vacuum generator can operate and produce the desired vacuum under a number of different conditions, such as different saw blade sizes, cutting speeds and the like. The vacuum generator can also be easily mounted on and removed from the saw along with the other slurry containment components. The separation tank, the suction bar, the pump assembly, blade guard and vacuum hose can be easily installed on existing saws and removed if desired. The components can be made available in kit form or installed at the factory.

The waste containment and separation system can be used in other applications beyond concrete saws. Wall saws, grinding heads and core drills also produce particulates that can be contained through application of one or more of the concepts described herein. For example, using high and low vacuum apertures in a pickup element conserves vacuum pressure and permits a selective arrangement of high vacuum pickup locations. Vacuum generators can also be driven off of the drive elements of the tools, if desired. Additionally, the concepts developed for separating air from a slurry for maintaining the integrity of the vacuum generator can be applied, to other applications. The amount of feedback of damaging particulates or other contaminants can be reduced, thereby extending the life of many components. Filters may not be necessary, as they reduce the vacuum and produce drag.

An example of a tool guard and material pickup assembly 600 (FIGS. 20–21) includes a tool guard 602, which in the present example is a blade guard for a saw blade, such as that used in concrete saws, flat saws and other cutting or processing equipment. The assembly also includes a material pickup assembly 604. The material pickup assembly 604 in the present example serves not only to pickup material produced during the cutting operation, but also to support the blade guard 602.

The blade guard extends partly about the saw blade 606 as the saw blade cuts concrete or other work material. The blade guard 602 defines a volume within which the saw blade operates as the saw blade cuts into the concrete. The blade guard includes at least a first wall 608 and a second wall 610 (FIG. 21) extending on opposite sides of the saw blade and having respective inside surfaces 612 and 614 facing each other and extending on respective sides of the saw blade. The first wall 608, and preferably the second wall 610, include respective edge portions 616 to substantially defining the lower-most portions of the blade guard, and which are adjacent but spaced apart from the concrete during operation. The blade guard also preferably includes one or more transverse extending rim or spacer walls 618 spanning and separating the first and second walls 608 and 610, respectively, and for completing the enclosure defined by the blade guard. The blade guard may include a handle 620 for lifting the blade guard from the material pickup assembly 604. The blade guard has one or more fluid supply tubes 622, for supplying fluid such as water to lubricate and cool the saw blade. The tubes 622 receive fluid through appropriate supply lines, as would be known to those skilled in the art. The saw blade is driven by the saw in a manner similar to that described previously, and the assembly 600 moves with the saw in a similar manner, as known to those skilled in the art.

Figure 21:
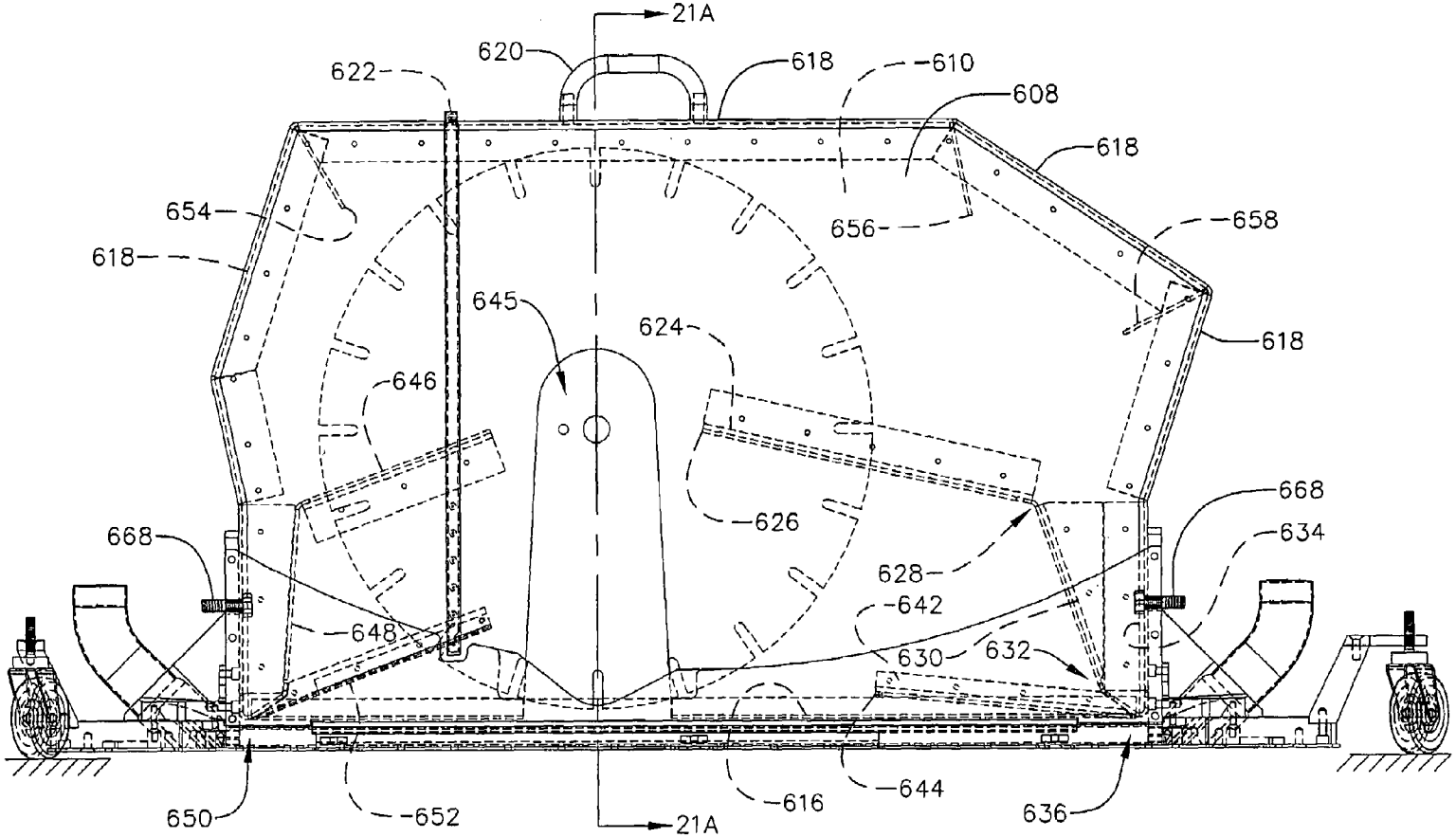
FIG. 21 is a side elevation view of the blade guard and material pickup assembly of FIG. 20.
Figure 21A:
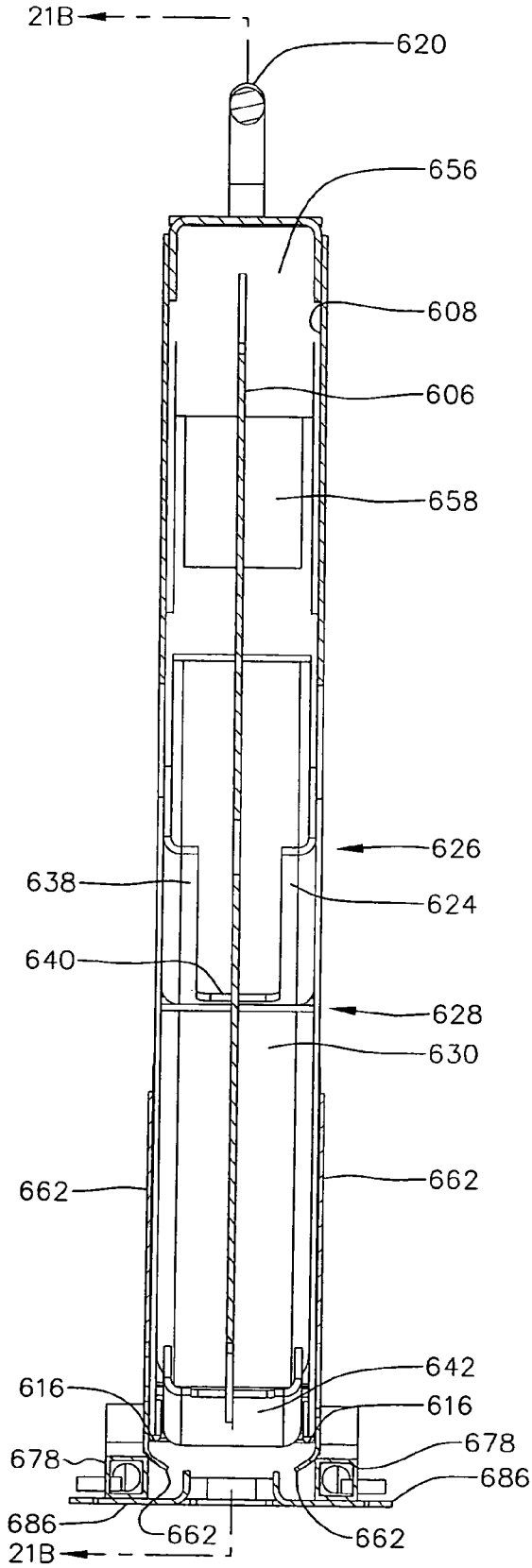
FIG. 21A is a transverse cross-section of the assembly of FIG. 21 taken along line 21A—21A.
Figure 21B:
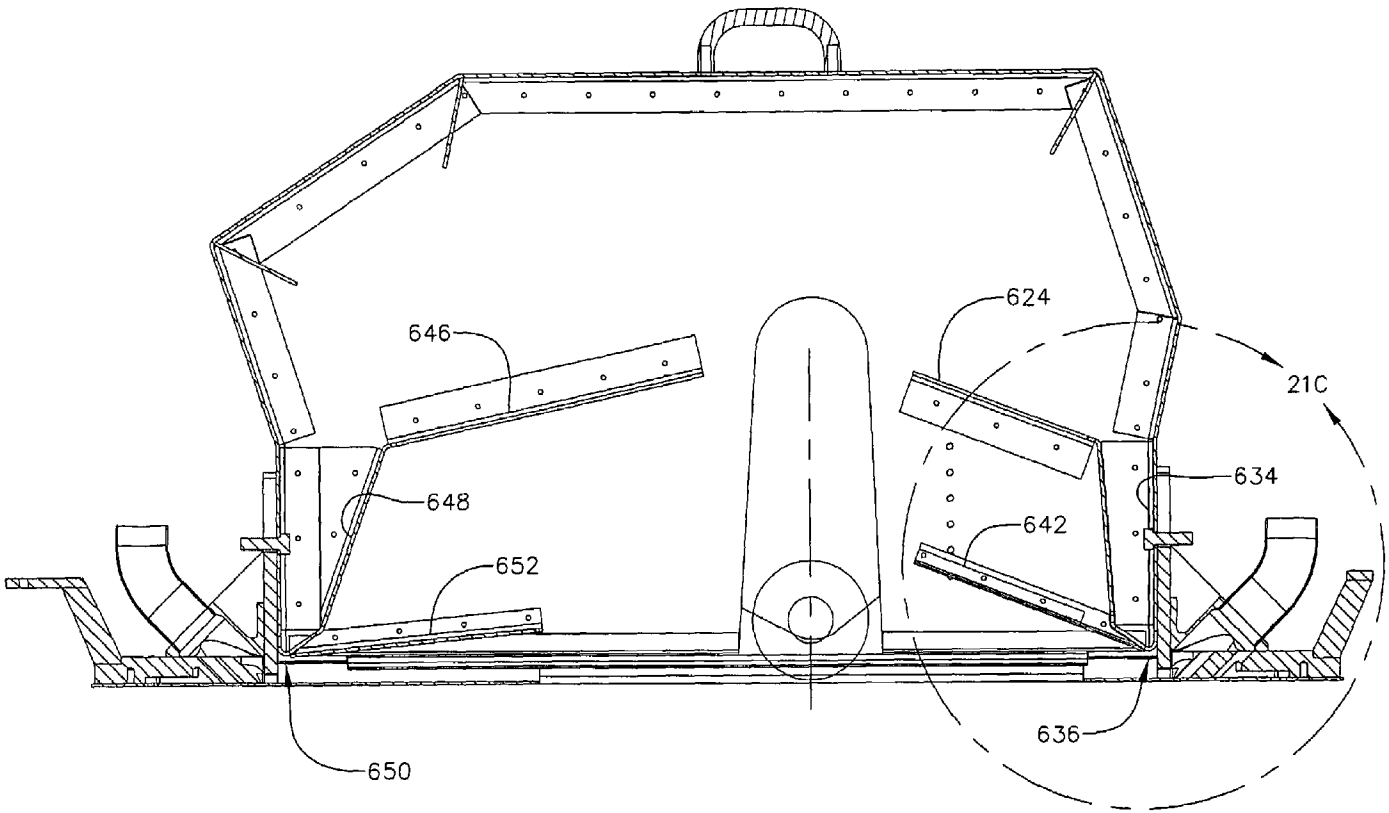
FIG. 21B is a longitudinal vertical cross-section of the assembly of FIG. 21 taken along line 21B—21B.

Considering the blade guard in this example in more detail with respect to FIG. 21, the inside surface of the first wall 608 includes at least one second wall, such as the water channel 624, contacting the inside surface of the first wall 608 and extending laterally from the inside surface in the same direction that the saw blade is spaced from the first wall, and extending longitudinally in a direction away from the edge portion 616. In the example shown in FIG. 21, the work surface is relatively horizontal and the first wall 608 extends substantially vertically upward from the edge portion 616, and the second wall portion slopes downwardly from a point 626 closer to the saw blade to a point 628 further away from the saw blade. The second wall portion in the example shown in FIG. 21 is fixed, bonded, riveted and/or welded to the inside surface of the first wall 608 and includes a rectangular flange portion extending to the interior of the blade guard from the inside surface of the first wall 608. The rectangular flange portion promotes water flow, with the assistance of gravity, downwardly and closer to the lower edge 616, and preferably it channels the fluid to a second water channel 630 having a steeper slope than the first water channel 624. The rectangular flange portion of the first water channel 624 also limits fluid flow along the inside surface of the first wall 608 and channels that fluid to the second water channel 630. In the example shown in FIG. 21, the water channel 624 is L-shaped and has the vertical leg mounted to the first wall and the second leg extending into the interior of the blade guard. It is positioned at an approximate vertical midpoint in the blade guard. The second water channel extends from the second point 628 to a point 632 adjacent the lower edge 616, where the second water channel terminates at a line spaced apart from the adjacent vertical wall 634 to form an opening 636 feeding into the material pickup assembly, as described more fully below.

In the example shown in FIG. 21, the first water channel 624 joins near the point 628 with a preferably mirror image water channel 638 contacting and fixed to the second wall 610, preferably having the same shape, size and slope as the first water channel 624, joining the first water channel through a joining wall 640. The joining wall 640 preferably begins approximately 1 in. outboard of the perimeter of the saw blade and extends to the outer point 628. The first and second water channels are preferably joined to or continuous between each other at the point 628, and the second water channel preferably spans the space between the first and second walls 608 and 610, respectively. The first and second water channels also reduce the spray of fluid and material upward and toward the walls 618, and thereby channel the fluid downward.

Figure 21C:
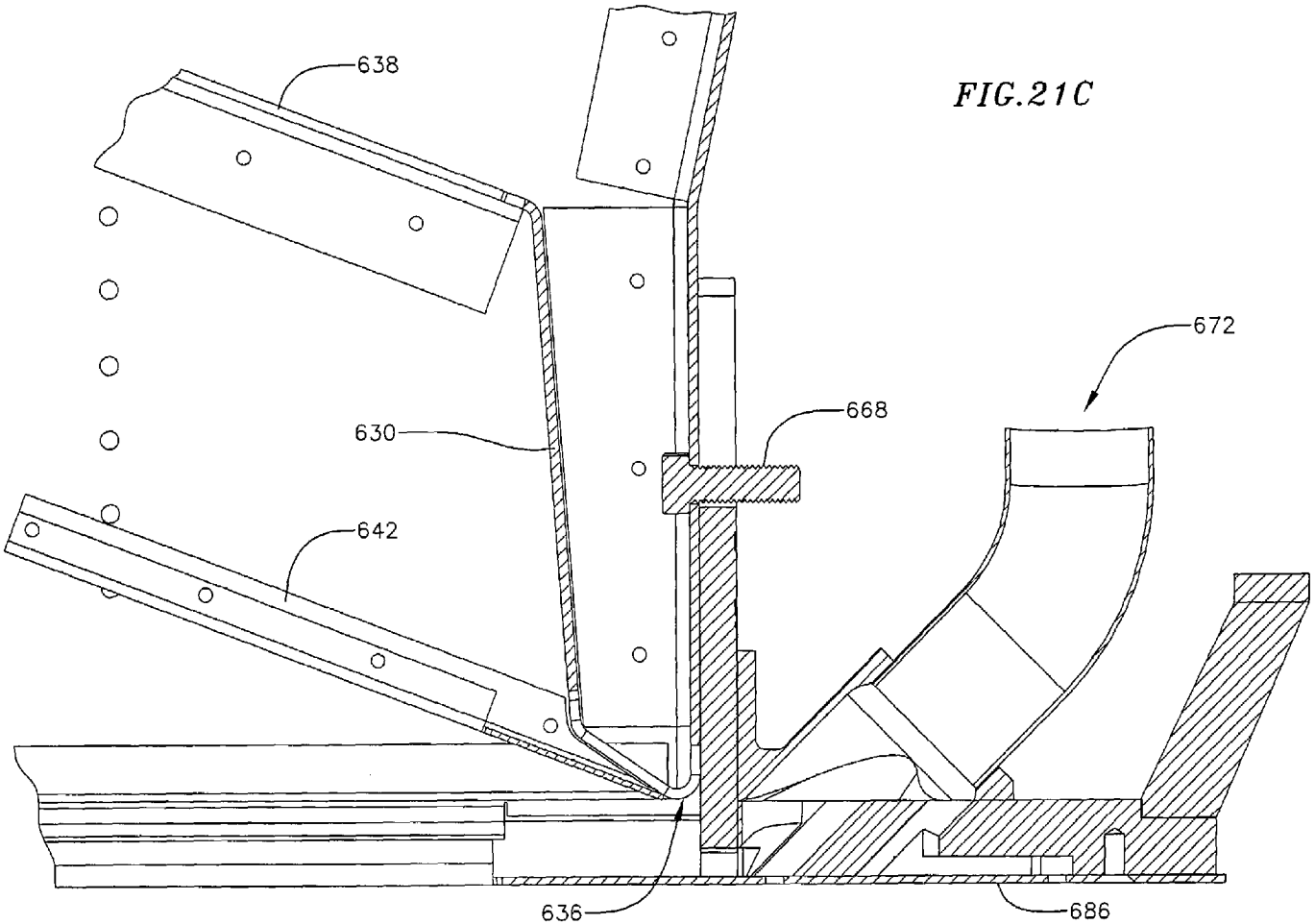
FIG. 21C is a detail of FIG. 21B.
Figure 21D:
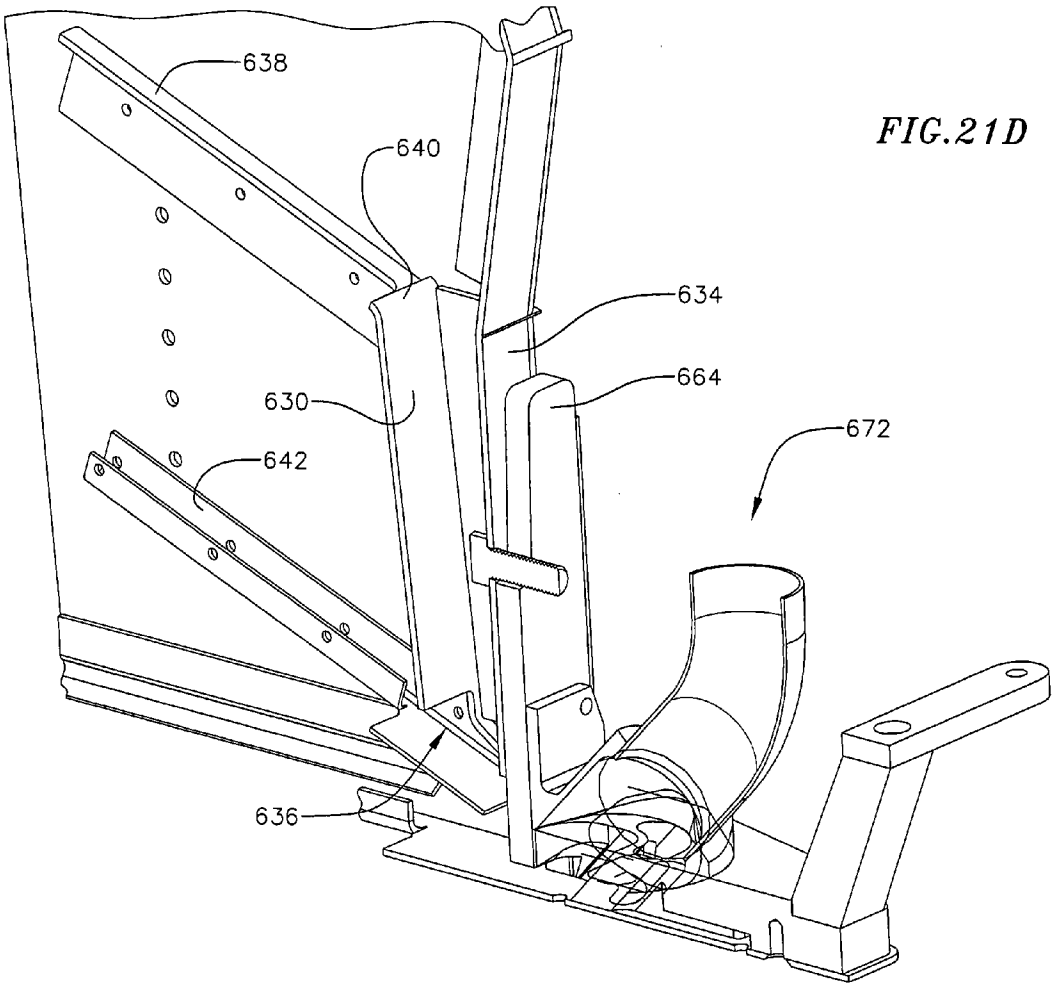
FIG. 21D is an isometric view of FIG. 21C.
Figure 22:
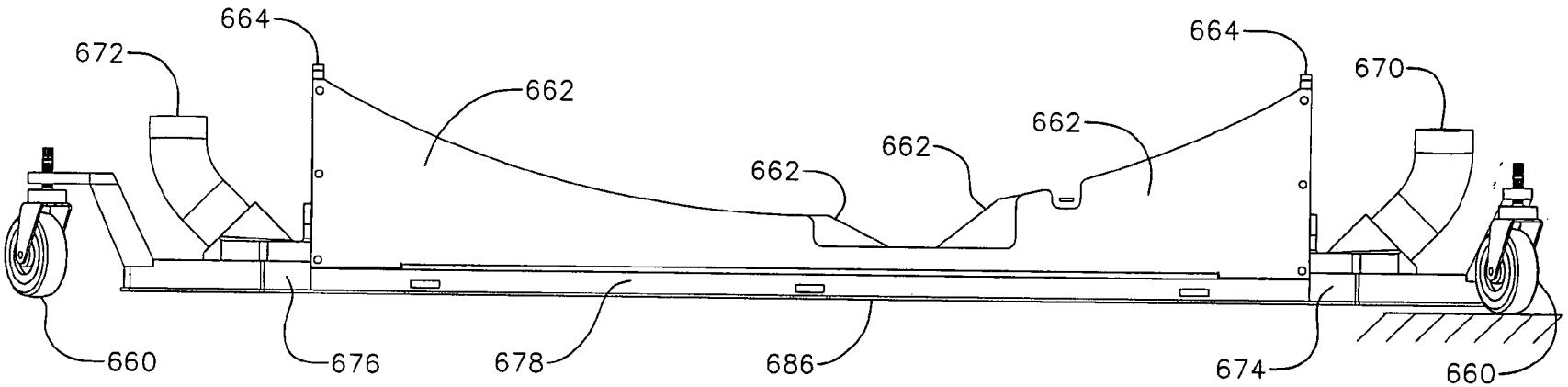
FIG. 22 is a side elevation view of the material pickup assembly of FIG. 20.
Figure 23:
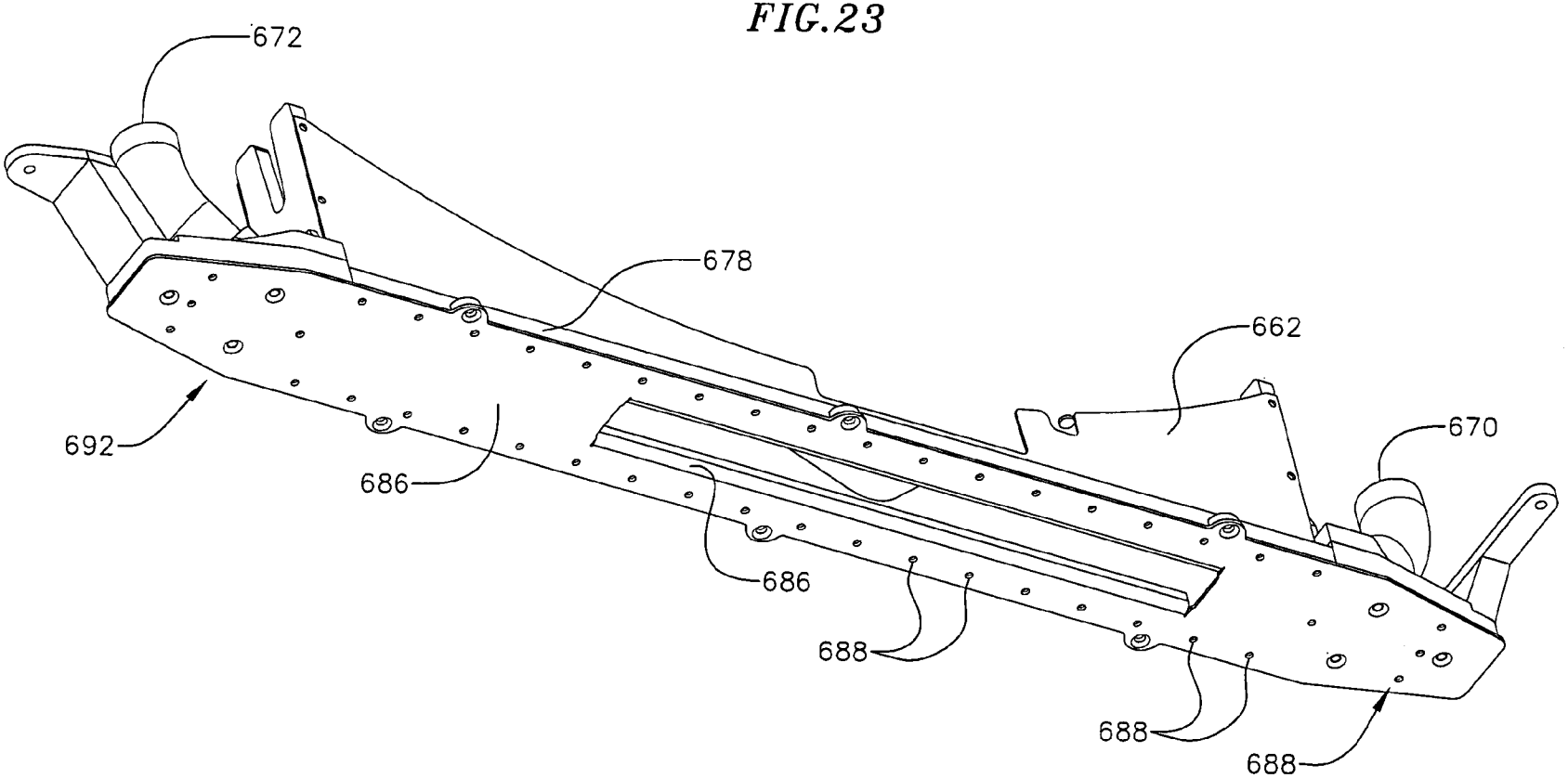
FIG. 23 is a lower isometric view of the material pickup element of FIG. 20.
Figure 24:
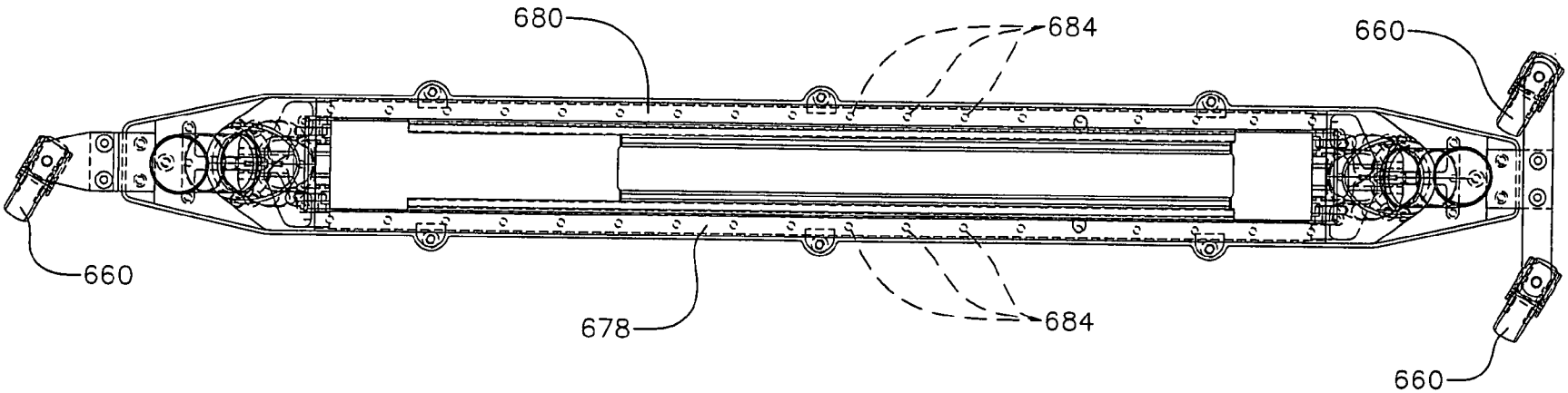
FIG. 24 is a top plan view of the material pickup element of FIG. 20.

A third water channel 642 has a smaller slope than the first channel 624 and extends from a point adjacent the opening 636 slightly upwardly and in the direction of the blade to a point 644. The third water channel shown has a U-shaped cross section (as seen in FIGS. 21C & 21D) and also channels fluid to the opening 636 and reduces the amount of fluid reaching the lower edge 616. The first, second and third water channels are positioned on that part of the blade guard which receives the spray of material and fluid from the saw blade. The blade guard and material pickup are reversible to accommodate a down cut saw and an up cut saw. The opening 645 in the first side of the blade guard permits viewing of the blade when positioned on the outside of the saw and accommodates the blade shaft when positioned adjacent the saw. A substantially similar opening is formed in the second side 610. The structure on the first side of the blade guard is preferably symmetrical with that on the opposite side. The water channels can take any number of shapes, sizes and configurations.

A fourth water channel 646, and a mirror image water channel on the opposite side of the blade, channel water to a fifth water channel 648 extending downwardly and away from the blade to an opening 650, which receives fluid for transfer to the material pickup assembly. A sixth water channel 652 has a greater slope than water channel 642, as it is closer to the blade. The sixth water channel 652 also channels fluid to the opening 650. The water channels have similar structures and functions. The blade guard also preferably includes deflector plates 654, 656 and 658 having a structure and function similar to that of the diagonal plate in Bassols, U.S. Pat. No. 5,564,408.

Figure 20:
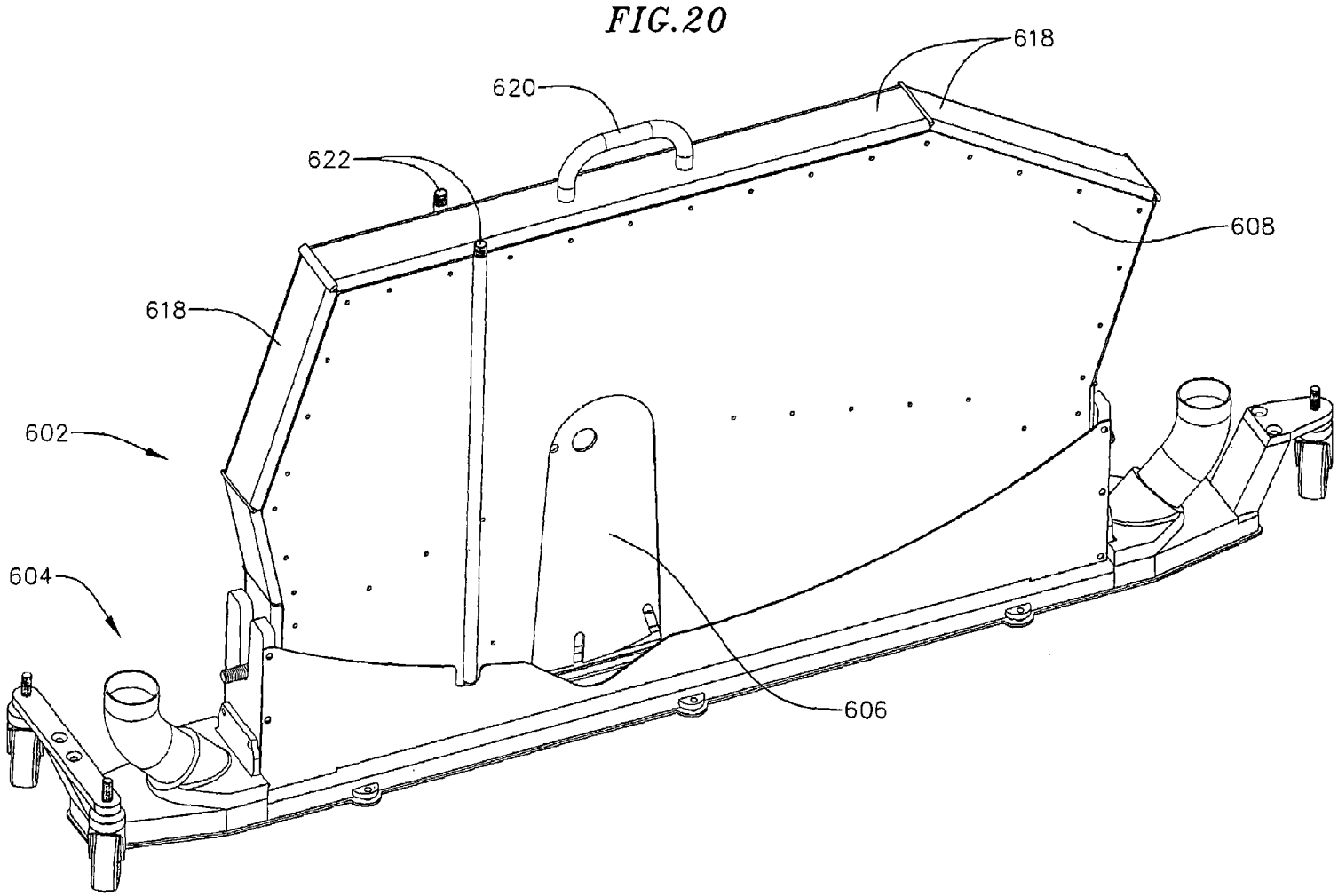
FIG. 20 is an upper isometric view of another example of a blade guard and another example of a material pickup assembly.

The example of FIGS. 20 and 21 also includes a blade guard support, which in this example also serves as the vacuum assembly 604. The blade guard support includes at least one and preferably three rolling elements, casters or wheels 660 for supporting the blade guard support on the work surface. The wheels are adjustable vertically to adjust the relative spacing of the blade guard support, and in the present example the vacuum assembly, from the work surface. The wheels 660 support the blade guard support at the desired spacing from the work surface even when the blade guard is removed and then replaced. Re-adjustment of the blade guard upon replacement is not necessary. The blade guard support includes one or more walls 662 extending upward from the area where the lower edges 616 of the blade guard rest. The walls 662 help to support the blade guard. Mounting plates 664 include slots 666 for receiving fasteners, bolts 668 or other means (FIG. 21) for fixing the blade guard to the blade guard support. The blade guard fits within the enclosure defined by walls 662 and mounting plates 664.

Figure 26:
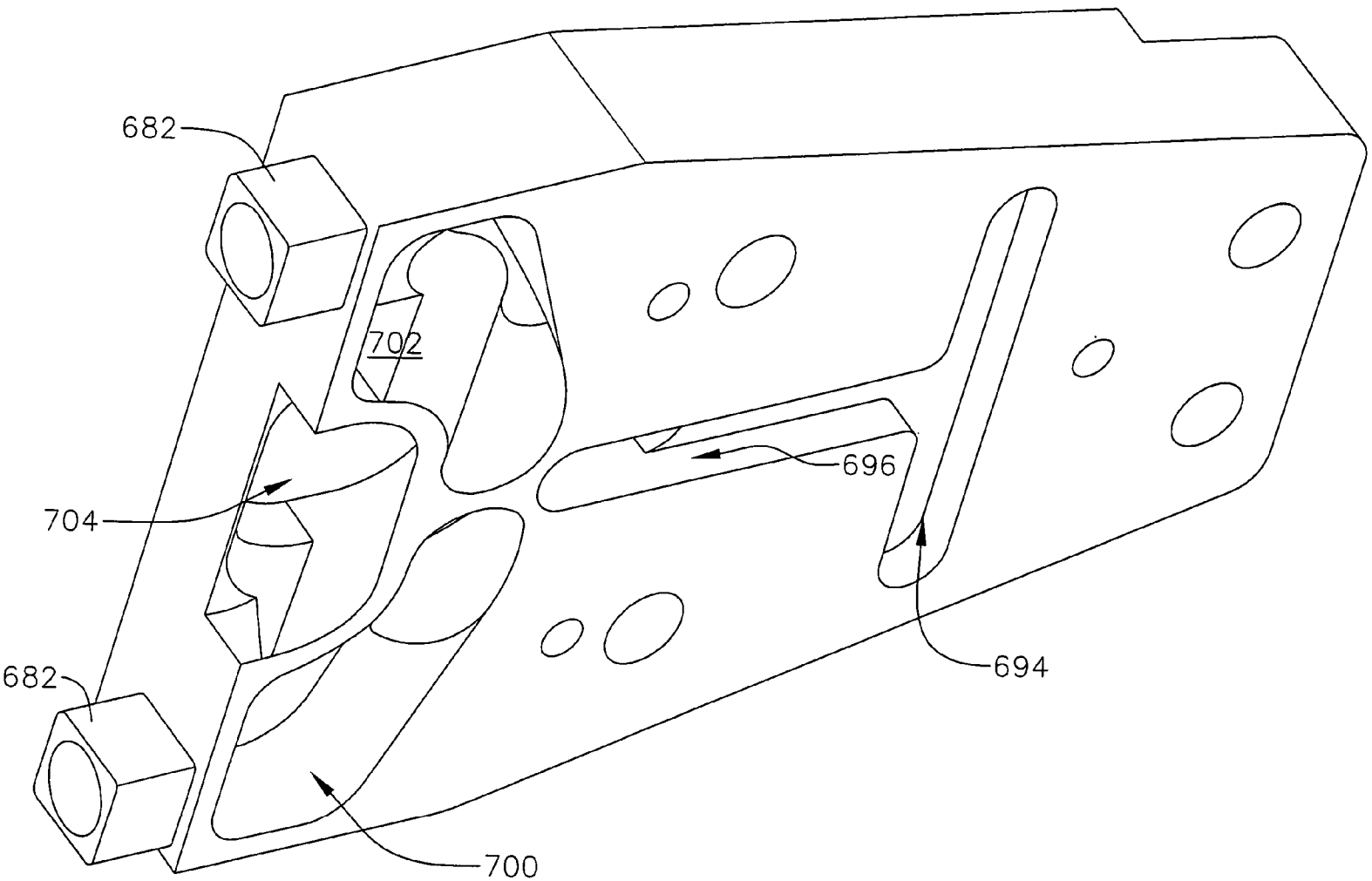
FIG. 26 is a lower isometric view of the manifold of FIG. 25.

In the present example shown in FIGS. 20 and 21, the assembly includes a material pickup assembly in the form of a vacuum assembly 604 having, in this example, first and second vacuum ports 670 and 672 at the two ends of the assembly coupled to vacuum manifolds 674 and 676, respectively. First and second vacuum tubes 678 and 680, respectively, extend almost the entire length of the vacuum assembly, and the ends of the vacuum tubes extend over and engage respective vacuum ports 682 on the manifolds (FIG. 26). Each vacuum tube is preferably a square aluminum tube having a three quarter inch internal dimension, and a plurality of vacuum holes 684 extend through the bottom walls of the tubes. Each vacuum tube includes a closure at approximately the center point thereof so the fluid does not flow from one half of the tube to the other half. The vacuum assembly also includes an aluminum wear plate 686 forming the bottom surface of the vacuum bar and having a plurality of vacuum holes 688 coaxial with and having the same diameter as the vacuum holes 684.

Figure 25:
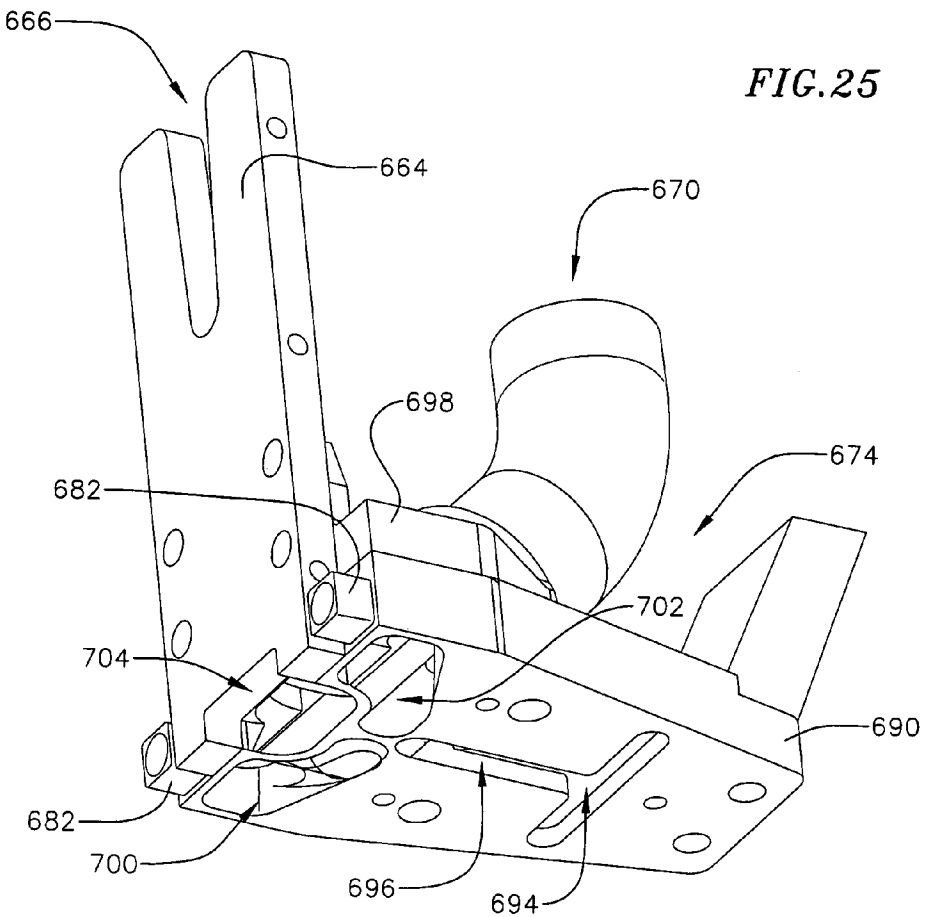
FIG. 25 is a lower isometric view of a manifold and associated mounting components for use with the material pickup assembly of FIG. 20.

Each manifold 674 and 676 preferably includes a substantially identical aluminum manifold plate 690 (FIGS. 25 & 26). Each manifold plate is covered on the bottom by the wear plate 686. The three transverse vacuum ports 692 open into a transverse channel 694. The channel 694 flows into a longitudinal channel 696 and out through a first opening through a coupling plate 698 which flows into the vacuum port 670. The first opening is preferably curved and is formed by walls which are preferably smooth and continuous, so as to minimize flow eddies and accumulation of debris.

Each vacuum tube is coupled to its port 682, which flows into respective second and third channels 700 and 702, which are preferably substantially identical to each other. Each channel extends away from the respective tube and inward toward the center of the manifold, and then flows upwardly through the coupling plate 698 and into the vacuum port 670. The flow from the channels combine in the coupling plate 698.

The material flow from the water channels inside the blade guard flow downward to the wear plate and through an opening in the mounting plate 664 and through a fourth opening 704 in the manifold. The fourth opening flows into a fourth channel in the manifold. The fourth channel extends outwardly away from the blade and upwardly toward the coupling plate 698, after which the flow joins the material flow from the other channels in the vacuum port 670.

Having thus described several exemplary implementations of the invention, it will be apparent that various alterations and modifications can be made without departing from the inventions or the concepts discussed herein. Such operations and modifications, though not expressly described above, are nonetheless intended and implied to be within the spirit and scope of the inventions. Accordingly, the foregoing description is intended to be illustrative only.

What is claimed is:

1. A tool guard for extending adjacent a moving tool, the tool guard comprising:

at least one wall extending adjacent the moving tool, and having an edge portion extending adjacent a work piece to be operated on by the tool and wherein the at least one wall extends away from the edge portion; and a second wall portion contacting the at least one wall along a line that extends in a direction at least partly horizontally and extending from the at least one wall in a substantially fixed direction toward the tool and extending from the edge portion in a direction away from the edge portion.

2. The tool guard of claim 1 wherein the at least one wall is relatively flat and wherein the second wall portion is substantially a flange portion extending from the at least one wall.

3. The tool guard of claim 2 wherein the second wall portion includes a first end portion adjacent the edge portion and a second end portion opposite the first end portion, and further including a third wall portion contacting the at least one wall and extending along the at least one wall from a point adjacent the second end portion of the second wall portion.

4. The tool guard of claim 1 wherein the moving tool is a saw blade, wherein the at least one wall is a relatively flat wall extending substantially parallel to the saw blade and wherein the second wall portion extends from at least one wall toward the saw blade.

5. A blade guard for a saw blade, the blade guard comprising:

first and second oppositely facing walls for extending along respective flat sides of the saw blade, and wherein the first wall includes an edge portion;

a third wall contacting the first facing wall and extending toward the second facing wall and having a first end portion and a second end portion wherein the third wall extends from the first end portion adjacent the edge portion away from the edge portion to the second end portion; and a fourth wall contacting the second facing wall wherein the third and fourth walls extend toward each other.

6. The blade guard of claim 5 wherein the third and fourth walls are substantial mirror images of each other.

7. The blade guard of claim 5 wherein the third and fourth walls include respective edges spaced apart from each other and including a joining wall joining portions of the third and fourth walls.

8. The blade guard of claim 7 further comprising a spacer wall and wherein the third and fourth walls and the joining wall extend toward the spacer wall and wherein the first end portion is spaced apart from the spacer wall.

9. The blade guard of claim 8 wherein the first end portion, the first and second side walls and the spacer wall define an opening.

10. A blade guard for a saw blade, the blade guard comprising:

first and second oppositely facing walls for extending along respective flat sides of the saw blade, and wherein the first wall includes an edge portion;

a third wall contacting the first facing wall and extending toward the second facing wall and having a first end portion and a second end portion wherein the third wall extends from the first end portion adjacent the edge portion away from the edge portion to the second end portion; and wherein the first and second side walls include respective edge portions extending between respective first and second end portions and configured to be placed adjacent a work surface and further comprising at least one spacer wall connecting the first and second side walls from the first end portions of the first and second side walls to the second end portions of the first and second side walls.

11. A blade guard for a saw blade, the blade guard comprising:

first and second oppositely facing walls for extending along respective flat sides of the saw blade, and wherein the first wall includes an edge portion;

a third wall contacting the first facing wall and extending toward the second facing wall and having a first end portion and a second end portion wherein the third wall extends from the first end portion adjacent the edge portion away from the edge portion to the second end portion; and wherein the third wall includes first and second segments wherein the first segment extends in a first direction and the second segment extends in a second direction.

12. The blade guard of claim 11 wherein the second direction is toward a center portion of the saw blade.

13. The blade guard of claim 11 wherein the second segment extends on each side of the saw blade.

14. The blade guard of claim 11 wherein the first segment contacts the first and second oppositely facing walls.

15. A blade guard for a saw blade, the blade guard comprising:

first and second oppositely facing walls for extending along respective flat sides of the saw blade, and wherein the first wall includes an edge portion;

a third wall contacting the first facing wall and extending toward the second facing wall and having a first end portion and a second end portion wherein the third wall extends from the first end portion adjacent the edge portion away from the edge portion to the second end portion; and a removable carriage having at least one rolling element.

16. The blade guard of claim 15 wherein the carriage is configured to be supported at a selected distance from a surface and wherein the carriage is configured to allow adjustment of the selected distance.

17. The blade guard of claim 15 wherein the carriage includes a suction bar.

18. A blade guard assembly comprising:

a blade guard support configured to be positioned on a support surface, and including an upper portion having at least one blade guard support element for supporting a blade guard for positioning relative to the support surface; and a blade guard having a lower portion configured to engage the upper portion of the blade guard support and removable from the blade guard support, wherein the blade guard is supported by the blade guard support when the blade guard contacts the at least one blade guard support element.

19. The assembly of claim 18 wherein the blade guard support includes at least one rolling element positioned on the blade guard support so as to contact the support surface.

20. The assembly of claim 18 wherein the blade guard is configured to accept a saw blade and the blade guard support is configured to allow a saw blade to extend at least partly through the support.

21. The assembly of claim 18 wherein the blade guard support includes walls defining openings for applying a vacuum to the openings.

22. The assembly of claim 18 wherein the blade guard includes first and second oppositely facing walls to extend on opposite sides of a saw blade, wherein each of the first and second oppositely facing walls includes edge portions for contacting the blade guard support, and wherein the blade guard support includes surfaces complementary to the edge portions for supporting the blade guard.

23. The assembly of claim 22 wherein the blade guard support includes first and second side walls for extending adjacent respective ones of the first and second oppositely facing walls of the blade guard.

24. The assembly of claim 22 wherein the blade guard includes a least one fastener for securing the blade guard to the blade guard support.

25. The assembly of claim 22 further including at least one wall extending between the first and second oppositely facing walls and wherein the at least one wall includes means for securing the blade guard to the blade guard support.

26. The assembly of claim 25 wherein the first and second oppositely facing walls and the at least one wall define an enclosure with an opening facing the blade guard support and wherein the blade guard support includes respective walls extending adjacent and outside the first and second oppositely facing walls and the at least one wall.

27. The assembly of claim 26 wherein the respective walls in the blade guard support include two walls having fasteners for securing the blade guard to the blade guard support.

28. A tool guard and vacuum assembly comprising:

a tool guard configured to extend at least partly about a tool used to operate on a work piece so as to define a volume within which the tool operates;

a vacuum assembly assembled with the tool guard, including a plurality of walls defining openings for passing material through the openings; and a manifold coupled to the vacuum assembly and having at least two walls defining first and second passage ways, wherein the first passage way is in fluid communication with at least one of the openings, wherein the second passage way is not in fluid communication with the at least one of the openings, and wherein the first and second passage ways have different shapes.

29. The assembly of claim 28 wherein the first and second passage ways have different cross-sectional areas.

30. The assembly of claim 28 wherein the first and second passage ways follow different paths.

* * * * *